US006619247B2

(12) United States Patent
Kobayashi

(10) Patent No.: US 6,619,247 B2
(45) Date of Patent: Sep. 16, 2003

(54) VALVE OPERATING CONTROL SYSTEM FOR ENGINE

(75) Inventor: Toshiki Kobayashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,122

(22) Filed: Oct. 23, 2001

(65) Prior Publication Data

US 2002/0056426 A1 May 16, 2002

(30) Foreign Application Priority Data

Oct. 25, 2000 (JP) ..... 2000-325432

(51) Int. Cl.[7] ..... F01L 1/34

(52) U.S. Cl. ..... 123/90.15; 123/90.16; 123/90.17; 123/193.5; 123/198 F; 123/196 R; 123/196 A; 123/196 M

(58) Field of Search ..... 123/90.15, 90.16, 123/90.17, 90.18, 193.5, 193.3, 198 E, 198 F, 196 R, 196 A, 196 M, 196 C; 184/15.1, 15.2, 15.3

(56) References Cited

U.S. PATENT DOCUMENTS

| | | | | |
|---|---|---|---|---|
| 4,537,165 A | | 8/1985 | Honda et al. | 123/90.16 |
| 5,003,937 A | * | 4/1991 | Matsumoto et al. | 123/90.12 |
| 5,065,709 A | * | 11/1991 | Ito et al. | 123/90.15 |
| 5,280,770 A | | 1/1994 | Satou et al. | 123/90.15 |
| 5,704,315 A | * | 1/1998 | Tsuchida et al. | 123/90.16 |
| 5,797,363 A | * | 8/1998 | Nakamura | 123/90.17 |
| 6,076,492 A | * | 6/2000 | Takahashi | 123/90.17 |
| 6,131,541 A | * | 10/2000 | Hasegawa et al. | 123/90.18 |
| 6,289,861 B1 | * | 9/2001 | Suzuki | 123/90.17 |
| 6,520,139 B1 | * | 2/2003 | Kobayashi | 123/196 R |
| 6,532,930 B2 | * | 3/2003 | Kobayashi et al. | 123/196 R |

FOREIGN PATENT DOCUMENTS

| | | |
|---|---|---|
| EP | 63 179 108 | 7/1988 |
| EP | 0 937 865 A1 | 8/1999 |
| EP | 0 945 598 A2 | 9/1999 |
| JP | 10-89024 | 4/1998 |

OTHER PUBLICATIONS

Toshiki Kobayashi, Valve Operating Control System in Engine, U.S. patent application Publication, US 2002/0056425 A1, May 16, 2002.*

* cited by examiner

*Primary Examiner*—Thomas Denion
*Assistant Examiner*—Ching Chang
(74) *Attorney, Agent, or Firm*—Armstrong, Westerman & Hattori, LLP

(57) ABSTRACT

First and second valve-operating characteristic changing mechanisms for changing the valve lift and the valve timing of an intake valve respectively are provided on an intake side of an engine. A hydraulic pressure control valve for the first valve-operating characteristic changing mechanism is mounted on one side of a cylinder head, and an oil filter for the second valve-operating characteristic changing mechanism is mounted on the other side of the cylinder head. The hydraulic pressure control valve and the oil filter are mounted outside a chain cover covering a timing chain. Therefore, the control valve and the oil filter do not interfere with the timing chain, and the maintenance of the control valve and the oil filter is carried out without removal of the chain cover.

18 Claims, 14 Drawing Sheets

VALVE OPERATING CONTROL SYSTEM FOR ENGINE

BACKGROUND OF THE INVENTION

1. Field of the Invention

The present invention relates to a valve operating control system for an engine, including a first valve-operating characteristic changing mechanism adapted to change the valve lift, and a second valve-operating characteristic changing mechanism adapted to change the valve timing.

2. Description of the Related Art

There is a conventionally known a valve operating control system for an engine, which includes a valve-operating characteristic changing mechanism provided between a camshaft and a sprocket for driving the camshaft, so that the phase of the sprocket relative to the camshaft is changed in accordance with the operational state of the engine to change the valve timing. There is also such a valve operating control system known from Japanese Patent Application Laid-open No. 10-89024, in which an oil filter is disposed in an oil passage for supplying a working oil to the valve-operating characteristic changing mechanism.

In an engine including, in addition to a valve-operating characteristic changing mechanism of the above-described type adapted to change the valve timing, another valve-operating characteristic changing mechanism adapted to change the valve lift, if the positional relationship of an oil filter of the former valve-operating characteristic changing mechanism to a hydraulic pressure control valve for controlling the latter valve-operating characteristic changing mechanism is not taken into consideration, it is difficult to secure a mounting space of the oil filter, but also there is arisen a problem that the size of the engine is increased in order to engine such a mounting space. In addition, a timing chain for driving a camshaft is disposed on an end face of the cylinder head, and for this reason, it is necessary to take a measure for preventing the hydraulic pressure control valve and the oil filter from interfering with the timing chain.

SUMMARY OF THE INVENTION

Accordingly, it is an object of the present invention to ensure that the hydraulic pressure control valve for the valve-operating characteristic changing mechanism adapted to change the valve lift and the oil filer of the valve-operating characteristic changing mechanism adapted to change the valve timing are disposed rationally.

To achieve the above object, according to a first aspect and feature of the present invention, there is provided a valve operating control system for engine, comprising a first valve-operating characteristic changing mechanism adapted to change the valve lift, and a second valve-operating characteristic changing mechanism adapted to change the valve timing, wherein a hydraulic pressure control valve for controlling the first valve-operating characteristic changing mechanism and an oil filter mounted in an oil passage leading to the second valve-operating characteristic changing mechanism are mounted respectively on one side and the other side of a cylinder head at locations outside a loop of an endless transmitting belt for driving a camshaft.

With the above arrangement, the hydraulic pressure control valve for the first valve-operating characteristic changing mechanism is mounted on one side of the cylinder head at the location outside the loop of the endless transmitting belt, and the oil filter for the second valve-operating characteristic changing mechanism is mounted on the other side of the cylinder head. Therefore, the hydraulic pressure control valve and the oil filter can be disposed without interference with the endless transmitting belt and without interference with each other, thereby contributing to the compactness of the engine.

According to a second aspect and feature of the present invention, in addition to the first feature, the hydraulic pressure control valve and the oil filter are mounted outside a cover covering the endless transmitting belt.

With the above arrangement, the hydraulic pressure control valve and the oil filter are mounted outside the cover covering the endless transmitting belt. Therefore, the hydraulic pressure control valve and the oil filter can be removed without removal of the cover, leading to an enhanced maintenance, but also it is not necessary to provide an opening in the cover for mounting and removal of the hydraulic pressure control valve and the oil filter, whereby the structure of the cover is simplified.

According to a third aspect and feature of the present invention, in addition to the first or second feature, a mounted portion of the hydraulic pressure control valve and a mounted portion of the oil filter are connected to each other by reinforcing ribs and a mounting seat for the hydraulic pressure control valve for the second valve-operating characteristic changing mechanism mounted in the cylinder head.

With the above arrangement, the a mounted portion of the hydraulic pressure control valve for the first valve-operating characteristic changing mechanism and the mounted portion of the oil filter for the second valve-operating characteristic changing mechanism are connected to each other by the reinforcing ribs and the mounting seat for the hydraulic pressure control valve for the second valve-operating characteristic changing mechanism. Therefore, it is possible to enhance the rigidity of the cylinder head to which the hydraulic pressure control valve and the oil filter for the first and second valve-operating characteristic changing mechanisms are mounted.

According to a fourth aspect and feature of the present invention, in addition to any of the first to third features, the second valve-operating characteristic changing mechanism and the oil filter are mounted on the same side of the cylinder head.

With the above arrangement, the second valve-operating characteristic changing mechanism and the oil filter are mounted on the same side of the cylinder head and hence, the length of an oil passage connecting the second valve-operating characteristic changing mechanism and the oil filter to each other can be suppressed to the minimum.

According to a fifth aspect and feature of the present invention, in addition to the first feature, a mounting seat for the hydraulic pressure control valve for the second valve-operating characteristic changing mechanism is provided on an end face of the cylinder head sandwiched between a mounted portion of the hydraulic pressure control valve for the first valve-operating characteristic changing mechanism and a mounted portion of the oil filter.

With the above arrangement, the mounting seat for the hydraulic pressure control valve for the second valve-operating characteristic changing mechanism is provided on the end face of the cylinder head sandwiched between the mounted portion of the hydraulic pressure control valve for the first valve-operating characteristic changing mechanism and the mounted portion of the oil filter. Therefore, it is possible to prevent the hydraulic pressure control valve for the second valve-operating characteristic changing mechanism from interfering with the hydraulic pressure control valve for the first valve-operating characteristic changing mechanism and the oil filter, thereby providing the further compactness of the engine.

According to a sixth aspect and feature of the present invention, in addition to the fifth feature, the mounting seat for the hydraulic pressure control valve for the second valve-operating characteristic changing mechanism and the mounted portion of the hydraulic pressure control valve for the first valve-operating characteristic changing mechanism are connected to each other by reinforcing ribs.

With the above arrangement, the mounting seat for the hydraulic pressure control valve for the second valve-operating characteristic changing mechanism and the mounted portion of the hydraulic pressure control valve for the first valve-operating characteristic changing mechanism are connected to each other by the reinforcing ribs. Therefore, it is possible to enhance the rigidity of the cylinder head to which the hydraulic pressure control valves for the first and second valve-operating characteristic changing mechanisms are mounted.

According to a seventh aspect and feature of the present invention, in addition to the fifth feature, the mounting seat for the hydraulic pressure control valve and the mounted portion of the oil filter for the second valve-operating characteristic changing mechanism are connected to each other by reinforcing ribs.

With the above arrangement, the mounting seat for the hydraulic pressure control valve and the mounted portion of the oil filter for the second valve-operating characteristic changing mechanism are connected to each other by reinforcing ribs. Therefore, it is possible to enhance the rigidity of the cylinder head to which the hydraulic pressure control valve and the oil filter for the second valve-operating characteristic changing mechanism are mounted.

According to an eighth aspect and feature of the present invention, in addition to the fifth feature, the mounting seat for the hydraulic pressure control valve for the second valve-operating characteristic changing mechanism is connected to the mounted portion of the hydraulic pressure control valve for the first valve-operating characteristic changing mechanism and the mounted portion of the oil filter by reinforcing ribs.

With the above arrangement, the mounting seat for the hydraulic pressure control valve for the second valve-operating characteristic changing mechanism is connected to the mounted portion of the hydraulic pressure control valve for the first valve-operating characteristic changing mechanism and the oil filter by the reinforcing ribs. Therefore, it is possible to enhance the rigidity of the cylinder head to which the hydraulic pressure control valves for the first and second valve-operating characteristic changing mechanisms and the oil filter are mounted.

According to a ninth aspect and feature of the present invention, in addition to the first feature, a mounted portion of the oil filter protrudes from the side of the cylinder head.

With the above arrangement, the mounted portion of the oil filter protrudes from the side of the cylinder head and hence, the rigidity of the cylinder head can be enhanced.

According to a tenth aspect and feature of the present invention, in addition to the ninth feature, the mounted portion of the oil filter protruding from the side of the cylinder head is box-shaped.

With the above arrangement, the mounted portion of the oil filter protruding from the side of the cylinder head is box-shaped and hence, the rigidity of the cylinder head can be enhanced effectively.

According to an eleventh aspect and feature of the present invention, in addition to the first feature, a guide for the endless transmitting belt is fixed to a mounted portion of the oil filter.

With the above arrangement, the guide for the endless transmitting belt is fixed to the mounted portion of the oil filter and hence, the mounting rigidity of the guide for the endless transmitting belt can be enhanced.

According to a twelfth aspect and feature of the present invention, in addition to the first feature, a cover for the endless transmitting belt is fixed to a mounted portion of the oil filter.

With the above arrangement, the cover for the endless transmitting belt is fixed to the mounted portion of the oil filter and hence, the mounting rigidity of the cover for the endless transmitting belt can be enhanced.

According to a thirteenth aspect and feature of the present invention, in addition to the first feature, the filter housing of the oil filter is formed of a flat member.

With the above arrangement, the filter housing of the oil filter is formed of a flat member. Therefore, the filter housing is easy to form and is compact, as compared with a general cylindrical filter housing.

According to a fourteenth aspect and feature of the present invention, in addition to the first feature, an inlet chamber and an outlet chamber for the oil are defined within the filter housing of the oil filter coupled to the cylinder head, and a common twin ring-shaped seal member for sealing the inlet chamber and the outlet chamber is disposed on the coupled surface of the filter housing to the cylinder head.

With the above arrangement, the oil inlet and outlet chambers defined within the filter housing are sealed by the common twin ring-shaped seal member disposed on the coupled surface of the filter housing to the cylinder head. Therefore, it is possible to reduce the number of parts, as compared with a case where the inlet and outlet chambers are sealed by separate seal members.

According to a fifteenth aspect and feature of the present invention, in addition to the fourteenth feature, the outlet chamber is defined in the vicinity of bolt bores for fixing the filter housing to the cylinder head.

With the above arrangement, the outlet chamber is defined in the vicinity of a bolt bore for fixing the filter housing to the cylinder head and hence, a fastening force of a bolt passed through the bolt bore can be applied effectively to a portion near the outlet chamber, to thereby enhance the sealability.

According to a sixteenth aspect and feature of the present invention, in addition to the first feature, the filter housing of the oil filter coupled to the cylinder head is disposed to close an oil passage opening into an end face of the cylinder head and leading to the oil filter.

With the above arrangement, the oil passage opening into an end face of the cylinder head and leading to the oil filter is closed by the filter housing coupled to the cylinder head and hence, a member such as a blind plug for closing the oil passage is not required, leading to a reduced number of parts.

Each of an intake camshaft 12 and an exhaust camshaft 13 in an embodiment corresponds to the camshaft of the present invention; a timing chain 17 in the embodiment corresponds to the endless transmitting belt of the present invention; a chain guide 41 in the embodiment corresponds to the guide of the present invention; a chain cover 111 in the embodiment corresponds to the cover of the present invention; a first hydraulic pressure control valve 34 in the embodiment corresponds to the hydraulic pressure control valve for the first valve-operating characteristic changing mechanism of the present invention; and a second hydraulic pressure control valve 47 in the embodiment corresponds to the hydraulic pressure control valve for the second valve-operating characteristic changing mechanism of the present invention.

The above and other objects, features and advantages of the invention will become apparent from the following description of the preferred embodiment taken in conjunction with the accompanying drawings.

BRIEF DESCRIPTION OF THE DRAWINGS

FIGS. 1 to 14 show an embodiment of the present invention, wherein

FIG. 1 is a perspective view of an engine;

FIG. 2 is an enlarged view taken in a direction of an arrow 2 in FIG. 1;

FIG. 3 is an enlarged view taken in a direction of an arrow 3 in FIG. 1;

FIG. 4 is a sectional view taken along a line 4—4 in FIG. 3;

FIG. 5 is an enlarged view of an essential portion shown in FIG. 4;

FIG. 6 is a view similar to FIG. 5 but for explaining the operation;

FIG. 7 is a view taken along a line 7—7 in FIG. 3;

FIG. 8 is an enlarged sectional view taken along a line 8—8 in FIG. 3;

FIG. 9 is an enlarged sectional view of an essential portion shown in FIG. 3;

FIG. 10 is an enlarged sectional view taken along a line 10—10 in FIG. 2;

FIG. 11 is a sectional view taken along a line 11—11 in FIG. 3;

FIG. 12 is a sectional view taken along a line 12—12 in FIG. 11;

FIG. 13 is a sectional view taken along a line 13—13 in FIG. 3; and FIG. 14 is a view taken along a line 14—14 in FIG. 13.

DESCRIPTION OF THE PREFERRED EMBODIMENT

The present invention will now be described by way of an embodiment of the present invention with reference to the accompanying drawings.

Figure 1:
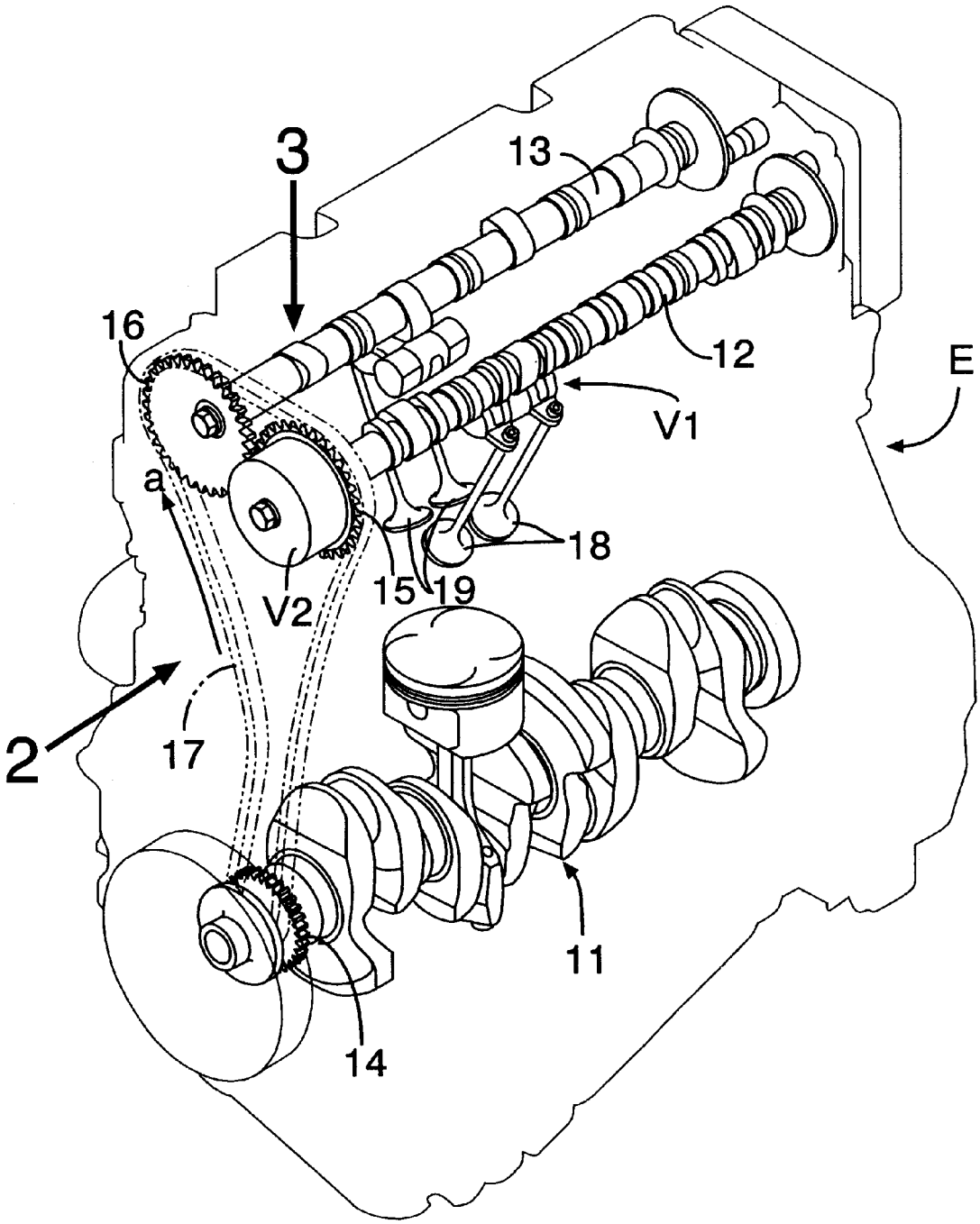

Referring to FIG. 1, a DOHC type 4-cylinder straight engine E includes a crankshaft 1, an intake camshaft 12 and an exhaust camshaft 13. A timing chain 17 is reeved around a crankshaft sprocket 14 mounted at end of the crankshaft 11, an intake camshaft sprocket 15 mounted at end of the intake camshaft 12 and an exhaust camshaft sprocket 16 mounted at end of the exhaust camshaft 13. The timing chain 17 is driven in a direction of an arrow a by the crankshaft 11, whereby the intake camshaft 12 and the exhaust camshaft 13 are rotated at a speed half of the speed of the crankshaft 11. Each of cylinders includes two intake valves 18, 18 driven by the intake camshaft 12, and two exhaust valves 19, 19 driven by the exhaust camshaft 13. The lift amount and opening duration of each of the two intake valves 18, 18 are capable of being varied by a first valve-operating characteristic changing mechanism V1 provided for each of the cylinders, and the timing of opening of each of the intake valves 18, 18 is capable of being varied by a second valve-operating characteristic changing mechanism V2 provided at an end of the intake camshaft 12.

Figure 2:
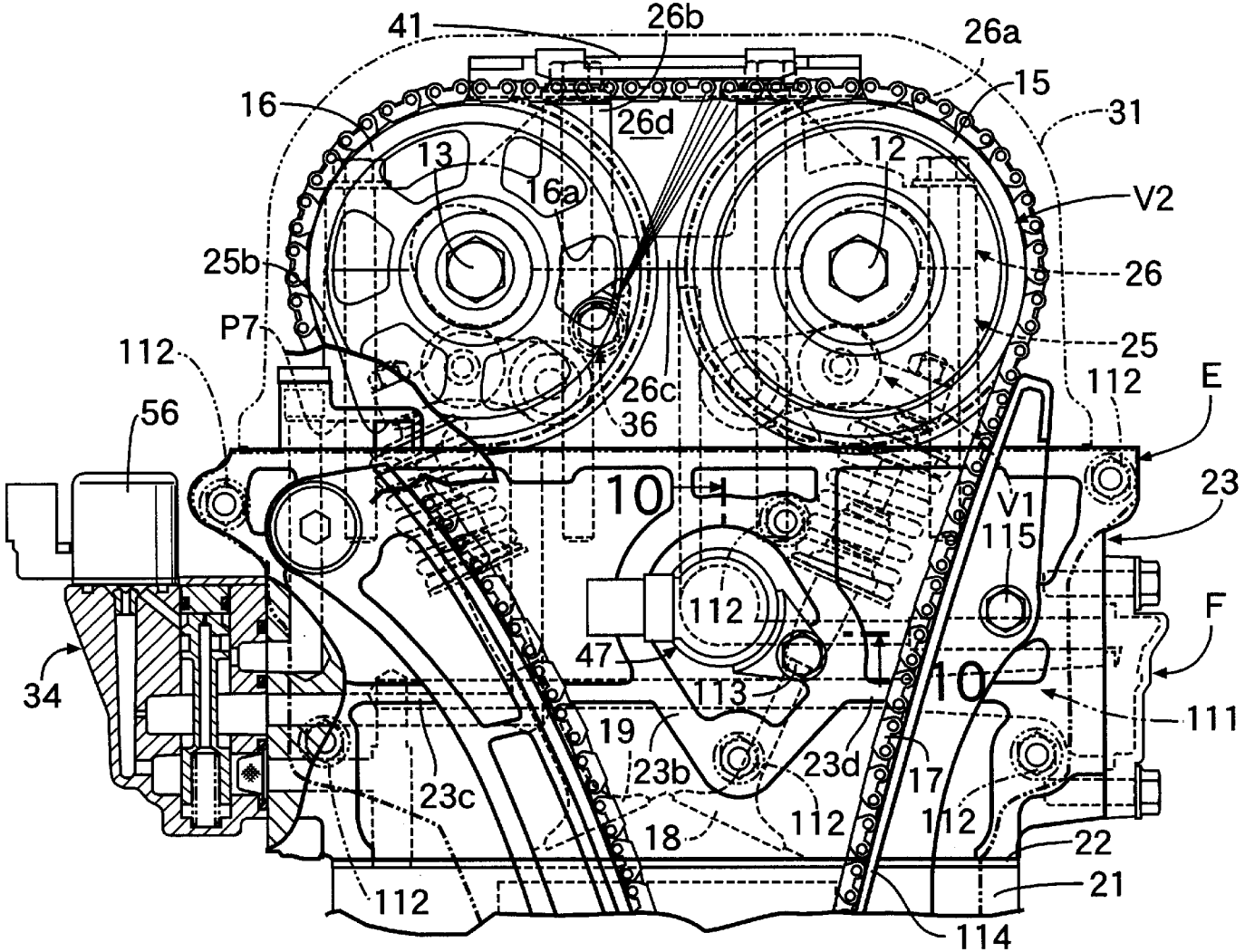
Figure 3:
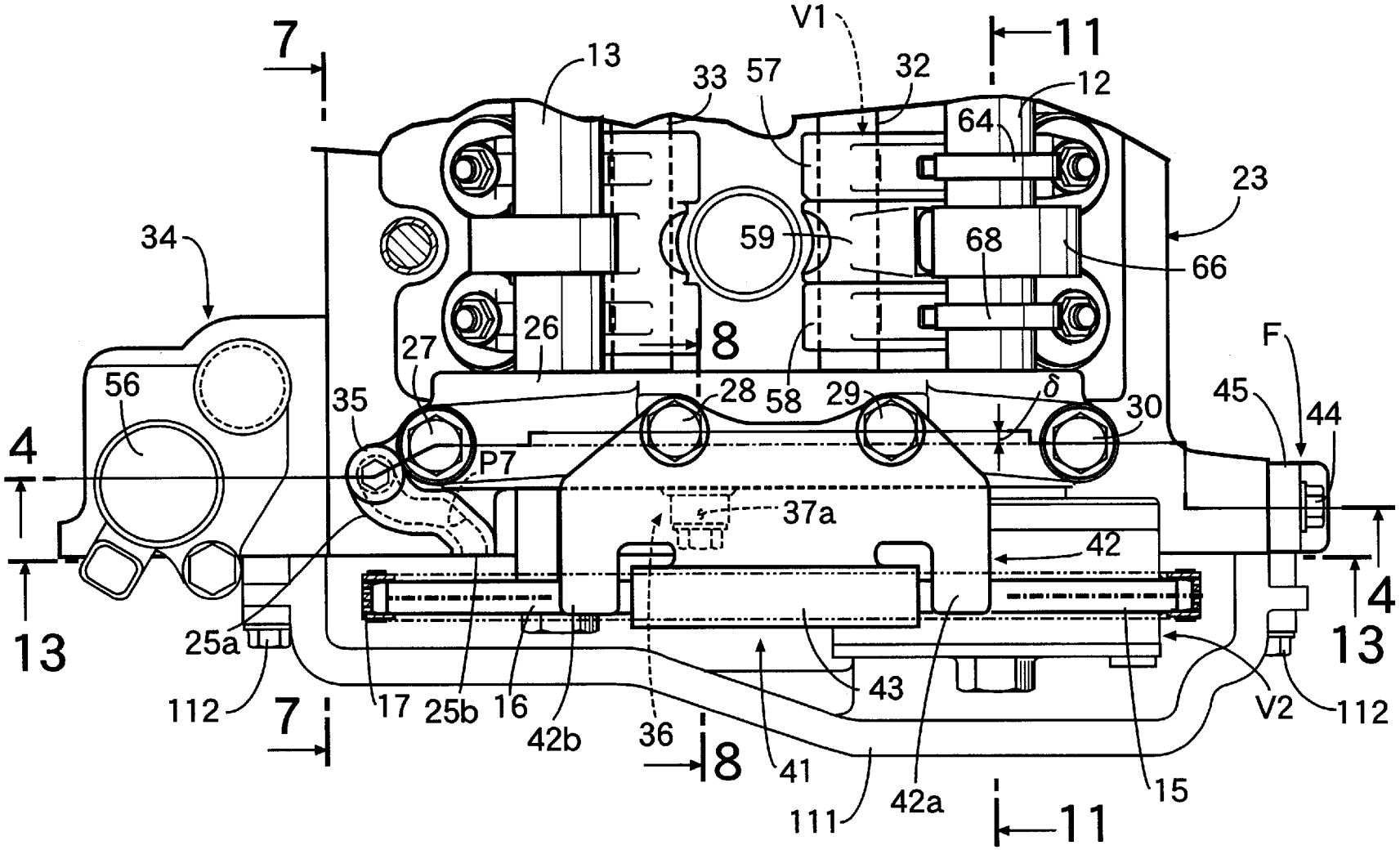
Figure 4:
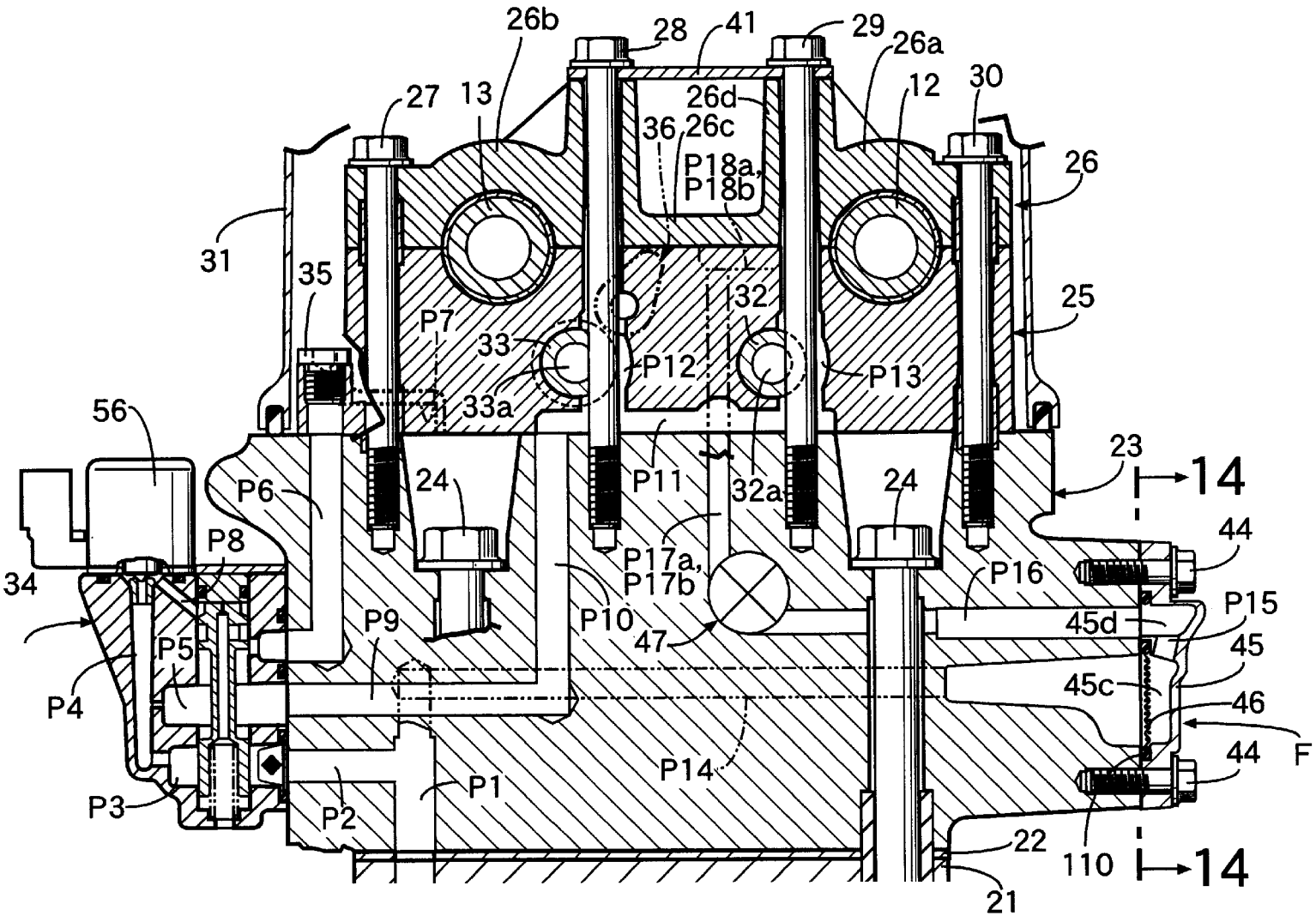

As shown in FIGS. 2 to 4, a cylinder head 23 is superposed on an upper surface of a cylinder block 21 with a gasket 22 interposed therebetween and is fastened to the upper surface by a plurality of bolts 24. A lower camshaft holder 25 and an upper camshaft holder 26 each also serving as a locker arm shaft holder are superposed on an upper surface of the cylinder head 23 and fastened together to the cylinder head 23 by four bolts 27, 28, 29 and 30. Upper portions of the lower camshaft holder 25 and the upper camshaft holder 26 are covered with a head cover 31. An intake rocker arm shaft 32 and an exhaust rocker arm shaft 33 are fixed to the lower camshaft holder 25, and the intake camshaft 12 and the exhaust camshaft 13 are rotatably carried on mating surfaces of the lower camshaft holder 25 and the upper camshaft holder 26.

Figure 5:
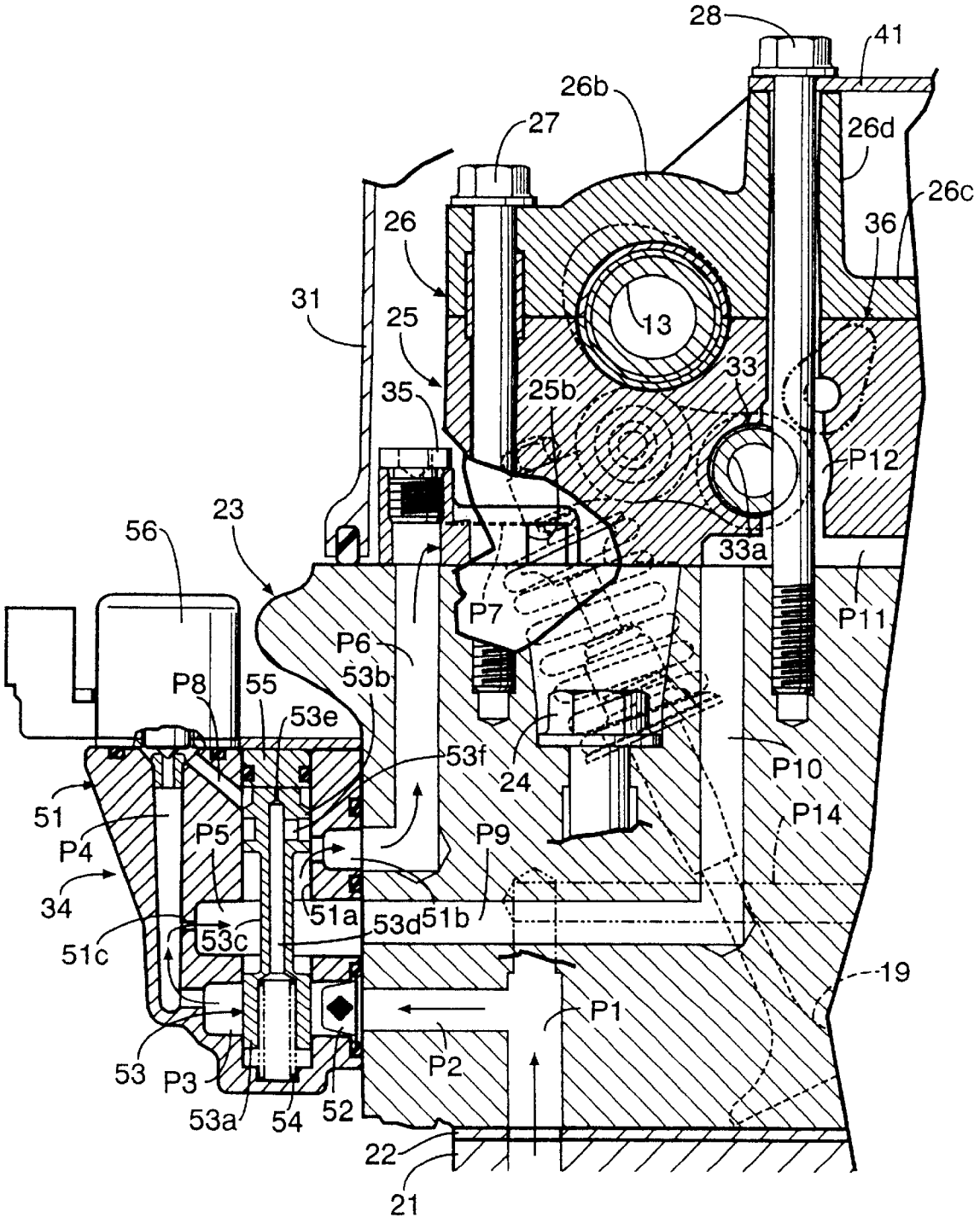
Figure 7:
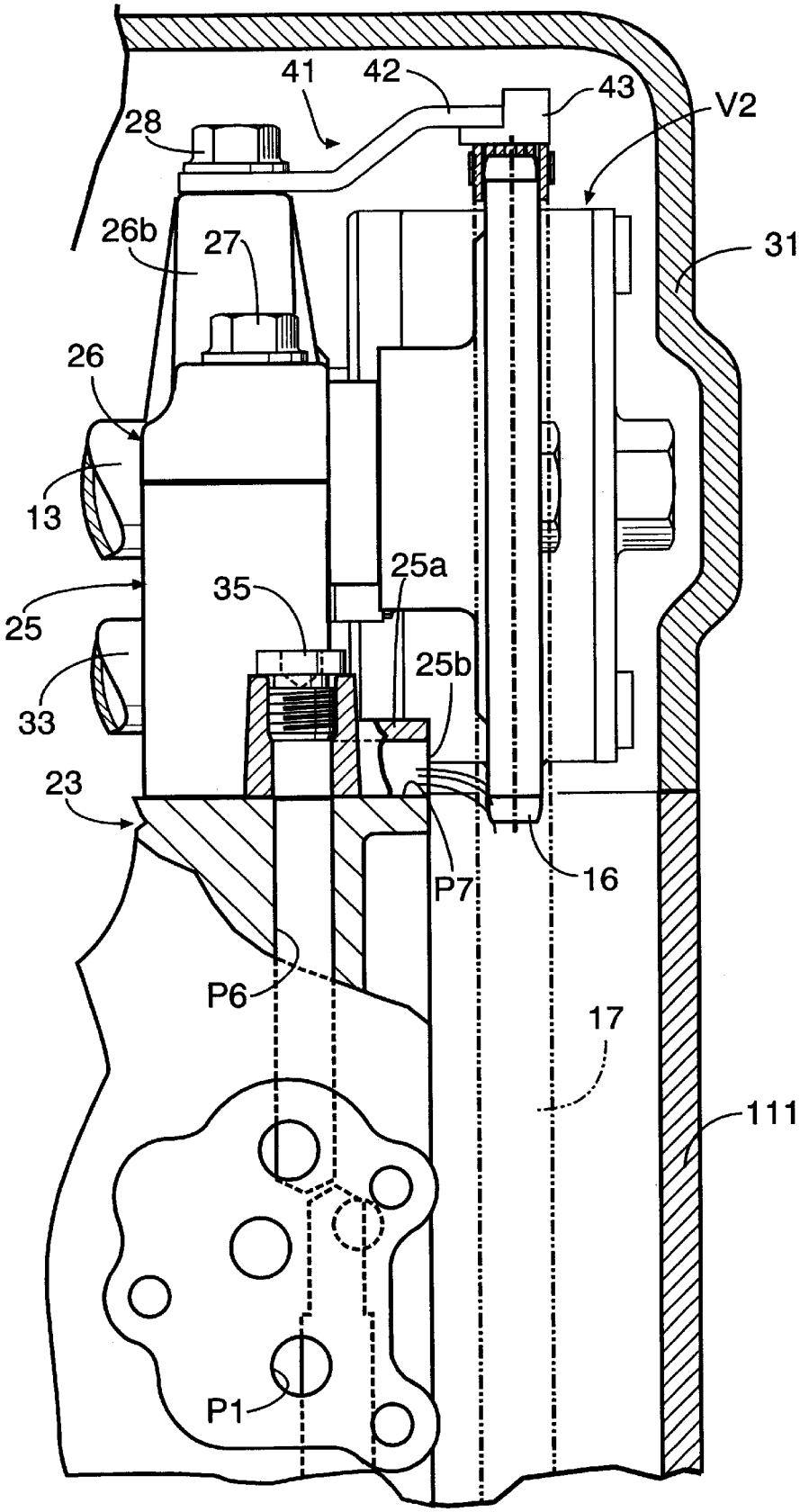

As can be seen from FIGS. 5 and 7, an oil passage P1 is defined in the cylinder head 23 and leading to an oil pump (not shown) driven by the crankshaft 11, an oil passage P2 is diverted from the oil passage P1 to communicate with a fist hydraulic pressure control valve 34 mounted on a side of the cylinder head 23. An oil passage P6 exiting the first hydraulic pressure control valve 34 into the cylinder head 23 extends upwards to communicate with an oil passage 7 defined in a lower surface (a surface mating with the cylinder head 23) of a bulge 25*a* integral with the lower camshaft holder 25. An oil drain port 25*b* is defined in a downstream end of the oil passage P7 and opposed to a zone of starting of the meshing of the exhaust camshaft sprocket 16 and the timing chain 17. The oil drain port 25*b* is narrowed slightly, as compared with a sectional area of a flow path of the oil passage P7, so that oil can be supplied reliably to the above-described meshing-starting zone. A blind plug 35 is mounted on an upper surface of a bulge 25*a* of the lower camshaft holder 25 located on an extension of an oil passage P6 extending upwards in the cylinder head 23.

An oil passage P9 exiting the first hydraulic pressure control valve 34 and extending horizontally within the cylinder head 23 communicates with an oil passage P10 extending upwards. The oil passage P10 opens into the upper surface of the cylinder head 23 and communicates with an oil passage P11 defined in a lower surface of the lower camshaft holder 25. The oil passage P11 in the lower camshaft holder 25 communicates with oil passages P12 and P13 defined around outer peripheries of two 28, 29 of the four bolts 27 to 30 for fastening the lower camshaft holder 25 and the upper camshaft holder 26 to the cylinder head 23. The oil passage P12 around the outer periphery of the bolts 28 communicates with an oil passage 33*a* defined axially in the exhaust rocker arm shaft 33, and the oil passage P13 around the outer periphery of the bolt 29 communicates with an oil passage 32*a* defined axially in the intake rocker arm shaft 32 and with an oil jet 36 provided in the lower camshaft holder 25.

Figure 8:
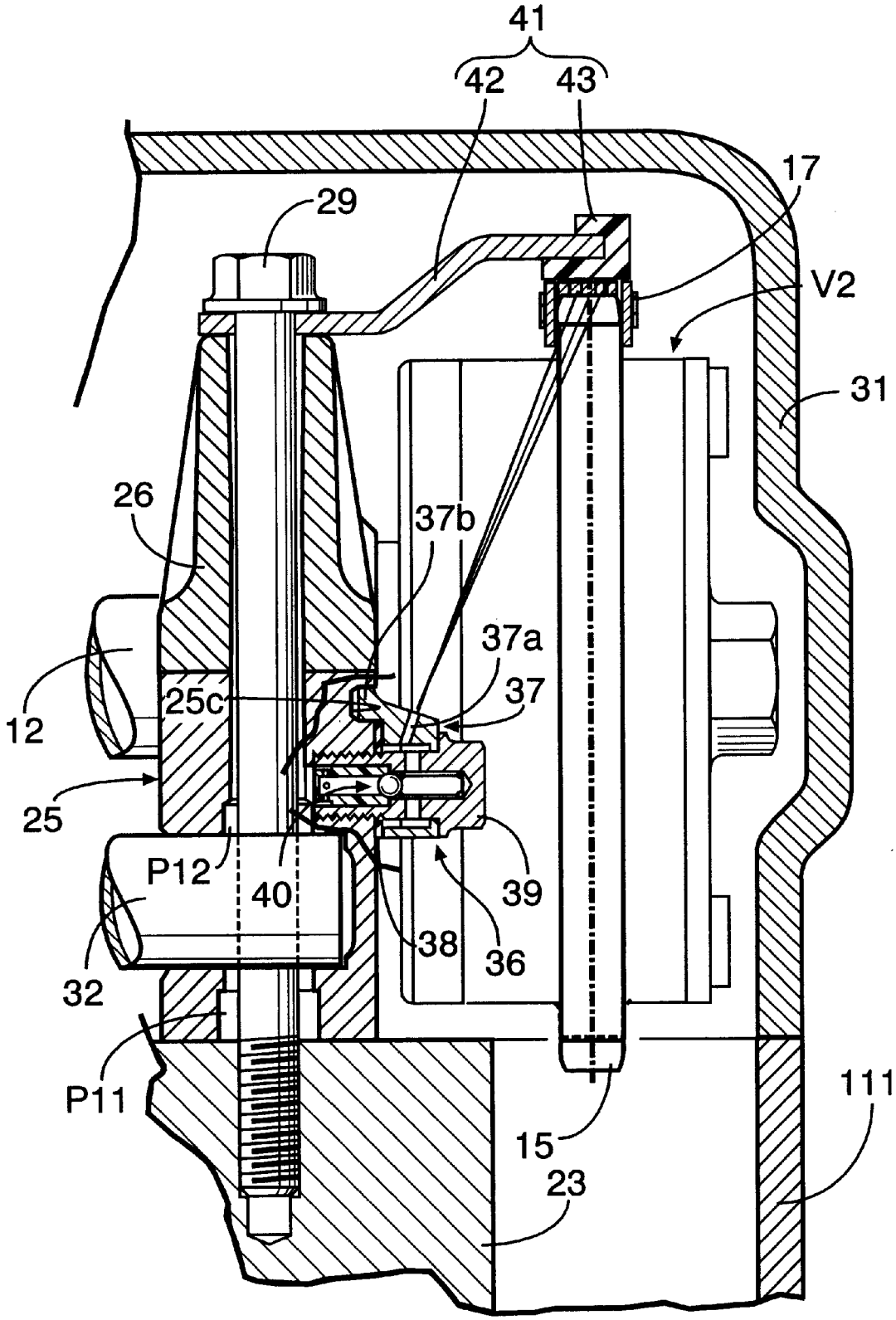

As can be seen from FIG. 8, the oil jet 36 is comprised of an oil jet body 37 having a nozzle bore 37*a*, and a mounting bolt 39 for fixing the oil jet body 37 to the lower camshaft holder 25 with a seal member 38 interposed therebetween. A relief valve 40 is accommodated within the mounting bolt 39, so that its upstream portion communicates with the oil passage P12 around the outer periphery of the bolt 28, and its downstream portion communicates with the nozzle bore 37*a* in the oil jet body 37. By fitting a positioning projection 37*b* formed on the oil jet body 37 into a positioning bore 25*c* defined in the lower camshaft holder 25, the oil jet 36 is positioned so that the nozzle bore 37*a* points to the zone of starting of the meshing of the intake camshaft sprocket 15 and the timing chain 17.

The oil jet 36 is disposed in a dead space defined between the lower camshaft holder 25 and the exhaust camshaft sprocket 16, so that it is fallen into an outside diameter of the exhaust camshaft sprocket 16 and hence, the influence exerted by the mounting of the oil jet 36 to other members can be suppressed to the minimum. Particularly, the oil jet 36 is disposed by effectively utilizing a dead space on a back of the exhaust camshaft sprocket 16, which is not occupied by the second valve-operating characteristic changing mechanism V2. Therefore, it is possible to suppress an increase in size of the engine E and the obstruction of the mounting of the other members due to the mounting the oil jet 36 to the minimum. As shown in FIG. 2, a lightening bore 16*a* made in the exhaust camshaft sprocket 16 for reducing the weight thereof is opposed to the oil jet 36. In other words, the oil jet 36 is provided to face the lightening bore 16*a* made in the exhaust camshaft sprocket 16 and hence, the mounted state of the oil jet 36 and the forgetting to mount the oil jet 36 can be checked easily through the lightening bore 16*a*.

If the entire mounting bolt 39 of the oil jet 36 is disposed within a region of the lightening bore 16*a* in the exhaust camshaft sprocket 16, the mounting bolt 39 can be removed through the lightening bore 16*a,* leading to an enhanced maintenance. If the entire oil jet 36 is disposed within a region of the lightening bore 16*a* in the exhaust camshaft sprocket 16, the oil jet 36 can be removed through the lightening bore 16*a,* leading to an enhanced maintenance.

As can be seen from FIGS. 3, 4 and 8, a chain guide 41 is fastened by the two bolts 28 and 29 for fastening the upper camshaft holder 26 (the inner bolts disposed inside the intake camshaft 12 and the exhaust camshaft 13). The two bolts 28 and 29 for fastening the upper camshaft holder 26 are offset by a distance δ in a direction away from the oil jet 36 with respect to the two bolts 27 and 30 disposed outside the bolts 28 and 29. Thus, it is possible to avoid the interference with the bolts 28 and 29 to secure the mounting space for the oil jet 36 and moreover to enhance the support rigidity of the oil jet 36.

One of the two offset bolts 28 and 29 is overlapped on the oil jet 36 as viewed in an axial direction of the exhaust camshaft 13 and hence, it is possible not only to reduce the size of the lower camshaft holder 25, but also to enhance the support rigidity of the exhaust camshaft 13. The reason is that if the oil jet 36 is disposed at a location closer to the bolts 29 than the bolt 28 (i.e., at a location farther from the exhaust camshaft 13), the size of the lower camshaft holder 25 is increased by a value corresponding to the space for the oil jet 36. On the other hand, if the oil jet 36 is disposed at a location displaced from the bolt 28 toward the exhaust camshaft 13, it is necessary to define a mounting bore for the oil jet 36 at a location closer to the surface of the lower camshaft holder 25 supporting the exhaust camshaft 13 and for this reason, there is a possibility that the support rigidity of the exhaust camshaft 13 is reduced. Further, the oil passage P12 is defined around the periphery of the bolt 28 to communicate with the oil jet 36 and hence, an oil passageway for supplying oil to the oil jet 36 can be simplified in arrangement and shortened.

The chain guide 41 includes a chain guide body 42 formed of a metal plate, and a slide member 43 made of a synthetic resin is mounted on an upper surface of a tip end of the chain guide body 42 to come into contact with the upper surface of the timing chain 17 for sliding movement. The timing chain 17 can be guide by the slide member 43 with its deflection inhibited, whereby the occurrence of the wear of the timing chain 17 can be inhibited, and the resistance to the sliding movements of the chain guide 41 and the timing chain 17 can be reduced. A pair of skip-preventing plates 42*a* and 42*b* are integrally formed at lengthwise opposite ends of the chain guide body 42. One of the skip-preventing plates 42*a* covers the above of the zone of starting of the meshing between the intake camshaft sprocket 15 and the timing chain 17 to prevent the skipping of the timing chain 17, and the other skip-preventing plate 42*b* covers the above of a zone of finishing of the meshing between the intake camshaft sprocket 15 and the timing chain 17 to prevent the skipping of the timing chain 17. The rigidity of the chain guide 41 is enhanced by the provision of the skip-preventing plates 42*a* and 42*b* and hence, the support rigidities of the intake camshaft 12 and the exhaust camshaft 13 are also further enhanced.

Since the skip-preventing plates 42*a* and 42*b* are formed at opposite ends of the slide member 43 made of the synthetic resin and hence, the durability of the slide member 43 is enhanced, notwithstanding that the slide member 43 is made of the synthetic resin.

The upper camshaft holder 26 includes a cam cap portion 26*a* adapted to hold the intake camshaft 12, a cam cap portion 26*b* adapted to hold the exhaust camshaft 13, and a connecting wall portion 26*c,* which connects the cam cap portions 26*a* and 26*b* to each other. A U-shaped lightening recess 26*d* is formed between the two bolts 28 and 29 and the connecting wall portion 26*c,* i.e., in a surface of the connecting wall portion 26*c* opposed to the chain guide 41. The cam cap portions 26*a* and 26*b* are connected at their lower ends to each other by the connecting wall portion 26*c* and also at their upper ends to each other by the chain guide 41. Namely, the chain guide 41 is bridged over the recess 26*d* formed between the cam cap portions 26*a* and 26*b* and the connecting wall portion 26*c* and hence, it is possible to couple the cam cap portions 26*a* and 26*b* by the connecting wall portion 26*c* and the chain guide 41, while lightening the upper camshaft holder 26, thereby ensuring a sufficient rigidity and enhancing the support rigidity of the intake camshaft 12 and the exhaust camshaft 13.

As described above, the chain guide 41 is fastened utilizing two 28 and 29 of the four bolts 27 to 30 for fastening the lower camshaft holder 25 and the upper camshaft holder 26 to the cylinder head 23 and hence, the number of parts is reduced and moreover, the mounting rigidity of the chain guide 41 is enhanced. In addition, the level of the seat faces of the two inner bolts 28 and 29 for fixing the chain guide 41 is restrained to the level of the timing chain 17, but the level of the seat faces of the two outer bolts which do not contribute to the fixing of the chain guide 41 can be lowered without being restrained to the level of the timing chain 17. Thus, the opposite ends of the upper camshaft holder 26 can be disposed at a level lower than the seat faces of the bolts 28 and 29 to reduce the size of the head cover 31.

Returning to FIG. 4, a filter housing 45 of an oil filter F is fixed to a side of the cylinder head 23 by bolts 44, 44. An oil passage P14 diverted from the oil passage P1 in the cylinder head 23 extends in a direction away from the first valve-operating characteristic changing mechanism V1 and via a filter element 46 within the filter housing 45 and an oil passage P15 to communicate with an oil passage P16 in the cylinder head 23. The oil passage P16 communicates with the second valve-operating characteristic changing mechanism V2 accommodated in the cylinder head 23 (in an end wall of the cylinder head 23 on the side of the timing chain 17, and a second hydraulic pressure control valve 47 communicates with an outer periphery of the intake camshaft 12 through oil passages P17*a* and P17*b* defined in the cylinder head 23 and oil passages P18*a* and P18*b* defined in the lower camshaft holder 25.

Figure 14:
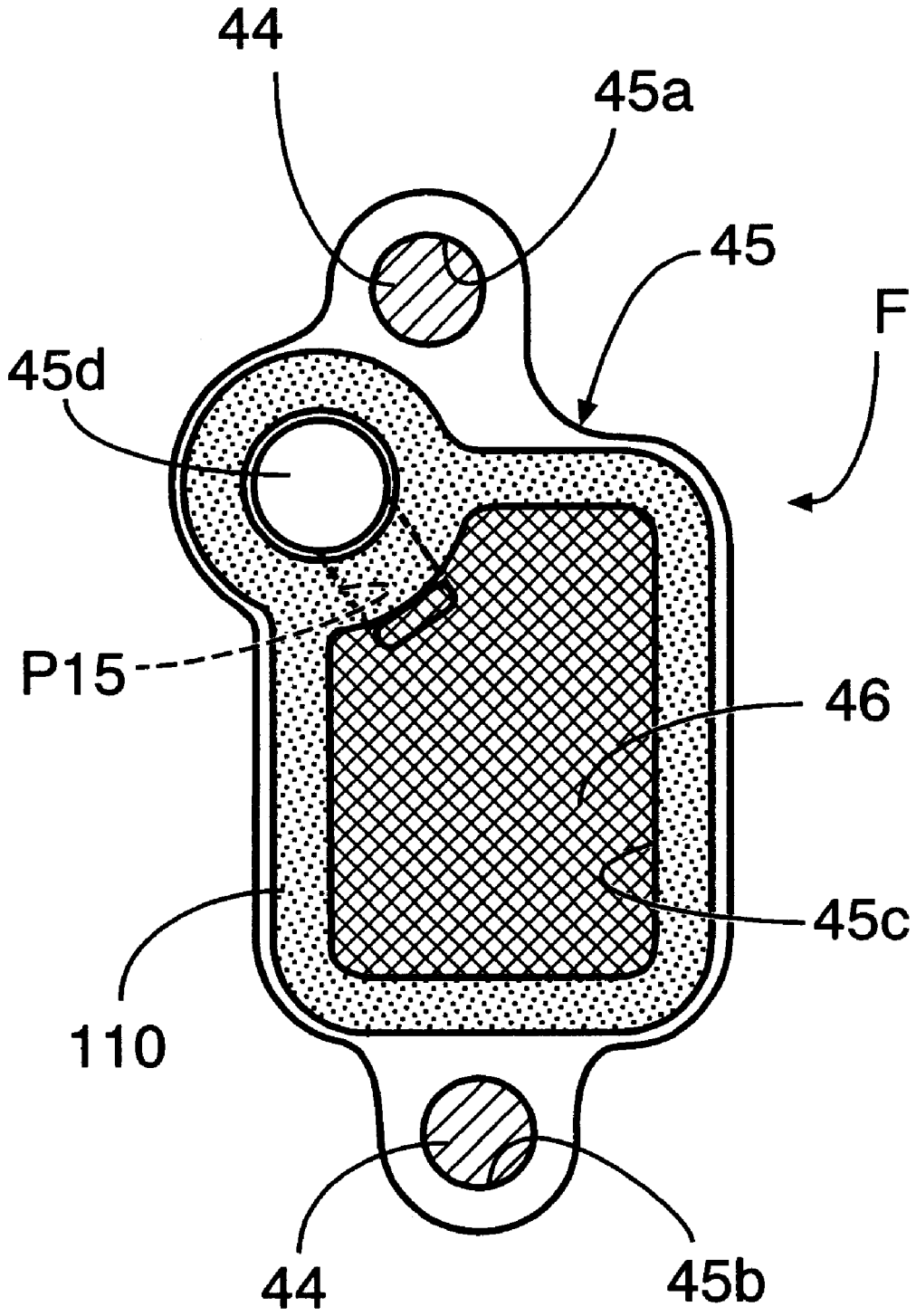

As can be seen from FIG. 14, the filter housing 45 of the oil filter F is a flat dish-shaped member and is fixed to the cylinder head 23 by the two bolts 44, 44 passed through bolt bores 45*a* and 45*b* made in vertically opposite ends of the housing 45. Since the filter housing 45 is formed of the flat member, the filter housing 45 is easy to form, as compared with a usual cylindrical filter housing and moreover, is compact. An oil passed from the oil passage P14 in the cylinder head 23 through the filter element 46 to enter an inlet chamber 45*c* within the filter housing 45 flows via an outlet chamber 45*d* within the filter housing 45 into the oil passage P16. The inlet chamber 45*c* and the outlet chamber 45*d* are sealed by a common twin ring-shaped seal member 110 and hence, the number of parts can be reduced, as compared with a case where the inlet chamber 45*c* and the outlet chamber 45*d* are sealed by separate seal members 110, respectively.

A mounted portion of the oil filer F protrudes from the side of the cylinder head 23, and a protruding portion is of a box-shape, as is the seal member 110. This can contribute to an enhancement in rigidity of the cylinder head 23. A chain guide 114 is fixed to the mounted portion of the oil filter F by a bolt 115 (see FIG. 2) and hence, the mounting rigidity of the chain guide 114 is enhanced. Further, a portion of the chain guide 111 fastened by the bolt 112 is disposed at the mounted portion of the oil filter F and hence, the fastened rigidity of the chain guide 111 is enhanced.

The outlet chamber 45*d* is provided in an upper portion of the filter housing 45 closer to the second oil pressure control valve 47 and hence, the oil passage P16 connecting the oil filter F to the second oil pressure control valve 47 can be shortened. Moreover, the outlet chamber 45*d* is provided at a location closer to the upper bolt bore 45*a* in the filter housing 45. Therefore, the fastening force of the upper bolt 44 passed through the bolt bore 45*a* can be effectively applied to a portion in the vicinity of the outlet chamber 45*d* and thus, a sufficient sealing force can be generated by a smaller number of the bolts 44. Moreover, the filter housing 45 is mounted to close the oil passages P14 and P16 which open into an end face of the cylinder head 23 and hence, it is unnecessary to close the oil passages P14 and P16 by a blind plug, leading to a reduction in number of parts.

Figure 13:
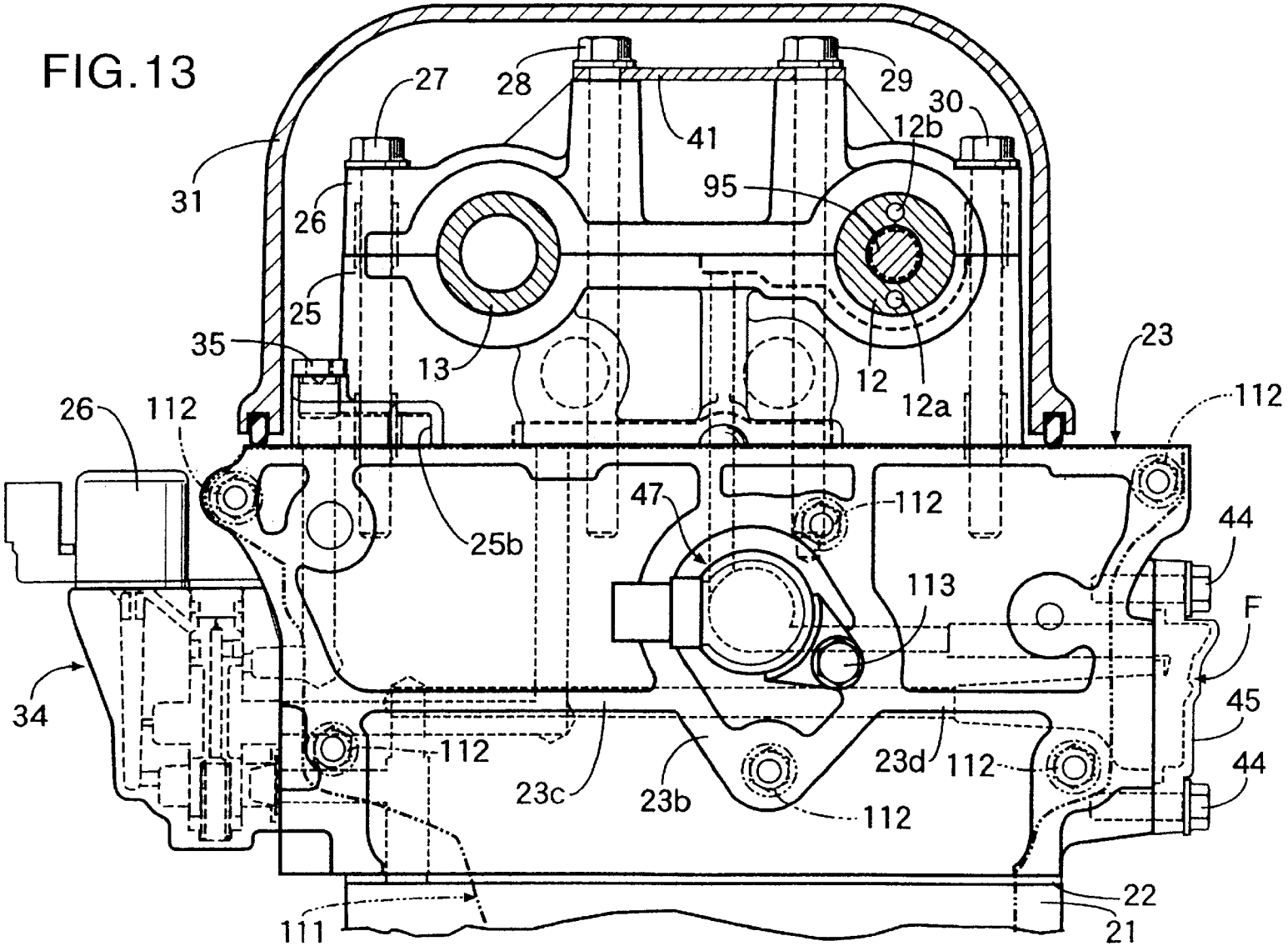

As shown in FIGS. 3 and 13, a chain cover 111 is fixed to the cylinder head 23 by a bolt 112 to cover a front surface of the timing chain 17, and the first hydraulic pressure control valve 34 and the oil filter F are mounted to a left side (one side) and a right side (the other side) of the cylinder head 23 at locations displaced from the chain cover 111, respectively. Because the first hydraulic pressure control valve 34 and the oil filter F are mounted at the locations displaced from the chain cover 111, as described above, they can be removed while the chain cover 111 is mounted, leading to an enhanced maintenance. Moreover, there is not a possibility that the first hydraulic pressure control valve 34 and the oil filter F interfere with each other, and there is also not a possibility that the first hydraulic pressure control valve 34 and the oil filter F interfere with the timing chain 17, because they are mounted outside a loop of the timing chain 17. Therefore, a sufficient space for mounting the oil filter F is secured, thereby making it possible to increase the size of the oil filter to enhance the filtering performance. In addition, it is unnecessary to make an opening in the chain cover 111 for performing the maintenance of the first hydraulic pressure control valve 34 and the oil filter F and hence, the structure of the chain cover 111 is simplified. Further, the oil filter F is mounted on the same side as the side on which the second valve-operating characteristic changing mechanism V2 is mounted, i.e., on the right side of the cylinder head 23 closer to the intake camshaft 12 and hence, the length of the oil passage between the oil filter F and the second valve-operating characteristic changing mechanism V2 can be suppressed to the minimum.

An annular mounting seat 23*b*, on which the second hydraulic pressure control valve 47 is mounted by a bolt 113, is formed on an end face of the cylinder head 23 sandwiched between the mounted portion of the first hydraulic pressure control valve 34 and the mounted portion of the oil filter F. The mounting seat 23*b* is connected to the mounted portion of the first hydraulic pressure control valve 34 and the mounted portion of the oil filter F by reinforcing ribs 23*c* and 23*d*, respectively. The rigidity of the cylinder head 23 is enhanced by the ribs 23*c* and 23*d*. Moreover, since the mounting seat 23*b* for the hydraulic pressure control valve 47 in the second valve-operating characteristic changing mechanism V2 is provided on the end face of the cylinder head 23 sandwiched between the mounted portion of the first hydraulic pressure control valve 34 for the first valve-operating characteristic changing mechanism V1 and the mounted portion of the oil filter F, it is possible to prevent the hydraulic pressure control valve 47 for the second valve-operating characteristic changing mechanism V2 from interfering with the hydraulic pressure control valve 34 for the first valve-operating characteristic changing mechanism V1 and the oil filter F, thereby providing the further compactness of the engine E.

The structure of the first hydraulic pressure control valve 34 will be described below with reference to FIG. 5.

The first hydraulic pressure control valve 34 mounted on the side of the cylinder head 23 includes a valve bore 51*a* defined in the valve housing 51. Opposite ends of an oil passage P3 extending through a lower portion of the valve bore 51*a* communicate with the oil passage P2 and an oil passage P4, respectively, and opposite ends of an oil passage P5 extending through an intermediate portion of the valve bore 51*a* communicate with the oil passages P9 and P4, respectively. An upper portion of the valve bore 51*a* communicates with the oil passage P6 through a drain port 51*b*. A filter 52 is mounted in an inlet of the oil passage P3. Defined in a spool 53 accommodated in the valve bore 51*a* are a pair of lands 53*a* and 53*b*, a groove 53*c* between the lands 53*a* and 53*b*, an internal bore 53*d* extending axially, an orifice 53*e* extending through an upper end of the internal bore 53*d*, and a groove 53*f* permitting the internal bore 53*d* to communicate with the drain port 51*b*. The spool 53 is biased upwards by a spring 54 accommodated in a lower end of the internal bore 53*d* to abut against a cap 55 which closes an upper end of the valve bore 51*a*. The oil passages P4 and P5 communicate with each other through the orifice 51*c*. The oil passage P4 and an oil passage P8 are connected to and disconnected from each other by an ON/OFF solenoid 56.

The structure of the first valve-operating characteristic changing mechanism V1 will be described below with reference to FIG. 9.

The first valve-operating characteristic changing mechanism V1 adapted to drive the intake valves 18, 18 includes first and second low-speed rocker arms 57 and 58 pivotally supported on the intake rocker arm shaft 32 for swinging movement, and a high-speed rocker arm 59 mounted between the low-speed rocker arms 57 and 58. Sleeves 60, 61 and 62 are press-fitted into intermediate portions of the rocker arms 57, 58 and 59, respectively. A roller 63 rotatably carried on the sleeve 60 abuts against a low-speed intake cam 64 provided on the intake camshaft 12; a roller 65 rotatably carried on the sleeve 61 abuts against a high-speed intake cam 66 provided on the intake camshaft 12; and a roller 67 rotatably carried on the sleeve 62 abuts against a low-speed intake cam 68 provided on the intake camshaft 12. The height of the lobe of the high-speed cam 66 is set larger than those of the lobes of a pair of the low-speed intake cams having the same profile.

A first switching pin 69, a second switching pin 70 and a third switching pin 71 are slidably supported within the three sleeves 60, 61 and 62, respectively. The first switching pin 69 is biased toward the second switching pin 70 by a spring 73 disposed in a compressed state between the first switching pin 69 and a spring seat 72 fixed to the sleeve 60, and is stopped at a location where it abuts against a clip 74 fixed to the sleeve 60. At this time, abutment faces of the first and second switching pins 69 and 70 are located between the first low-speed rocker arm 57 and the high-speed rocker arm 59, and abutment faces of the second and third switching pins 70 and 71 are located between the high-speed rocker arm 59 and the second low-speed rocker arm 58. An oil camber 58*a* defined in the second low-speed rocker arm 58 communicates with an oil passage 32*a* defined in the intake rocker arm shaft 32.

Figure 9:
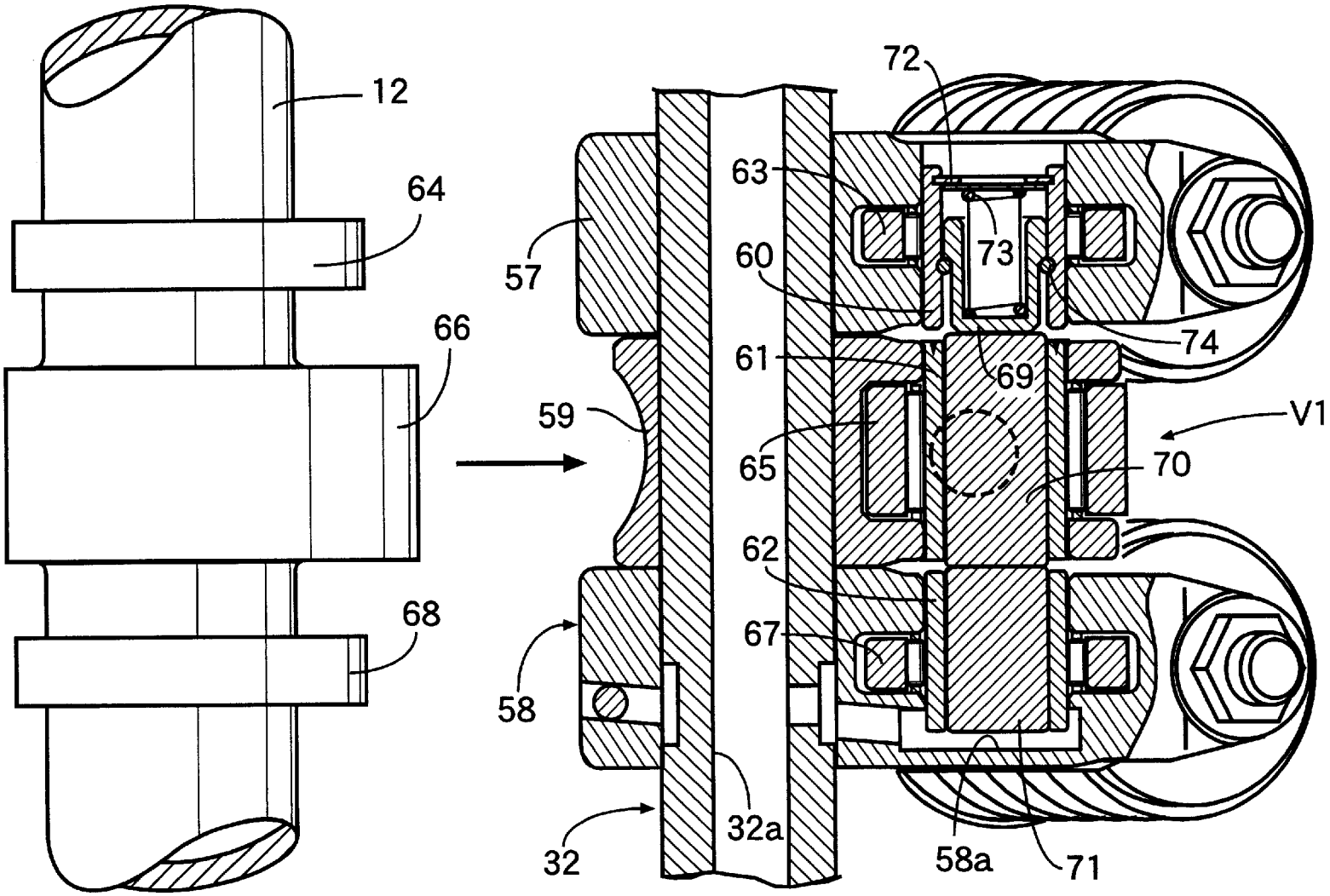

When no hydraulic pressure is applied to the oil passage 32*a* in the intake rocker arm shaft 32, the first, second and third switching pins 69, 70 and 71 are in positions shown in FIG. 9, and the first and second low-speed rocker arms 57 and 58 and the high-speed rocker arm 59 are freely swingable. Therefore, the pair of intake valves 18, 18 are driven with a low valve lift by the first and second low-speed rocker arms 57 and 58, respectively. At this time, the high-speed rocker arm 59 disconnected from the first and second low-speed rocker arms 57 and 58 is raced independently of the pair of intake valves 18, 18.

When a hydraulic pressure is applied to the oil camber 58*a* from the oil passage 32*a* in the intake rocker arm shaft 32, the first, second and third switching pins 69, 70 and 71 are moved against the force of the spring 73, whereby the first and second low-speed rocker arms 57 and 58 and the high-speed rocker arm 59 are integrally connected together. As a result, the first and second low-speed rocker arms 57 and 58 and the high-speed rocker arm 59 are driven in unison by the high-speed intake cam 66 having the higher lobe, and the pair of intake valves 18, 18 connected to the first and second low-speed rocker arms 57 and 58 are driven with a higher valve lift. At this time, the air of low-seed intake cams 64 and 68 are separated from the first and second low-speed rocker arms 57 and 58 and raced.

The structure of the second hydraulic pressure control valve 47 will be described below with reference to FIG. 10.

Five ports 82, 83, 84, 85 and 86 are defined in a cylindrical valve housing 81 fitted in the valve bore 23*a* made in the cylinder head 23. The central port 84 communicates with an oil passage P16; the ports 83 and 85 on opposite sides of the central port 84 communicate with a pair of oil passages P17*a* and P17*b*, respectively, and the ports 82 and 86 on opposite sides of the central port 84 communicate with a pair of draining oil passages P19*a* and P19*b*, respectively. A spool 90 having three grooves 87, 88 and 89 defined in its outer periphery is slidably received in the valve housing 81 and biased by a resilient force of a spring 91 mounted at one end of the spool 90 toward a linear solenoid 92 mounted at the other end of the spool 90.

Figure 10:
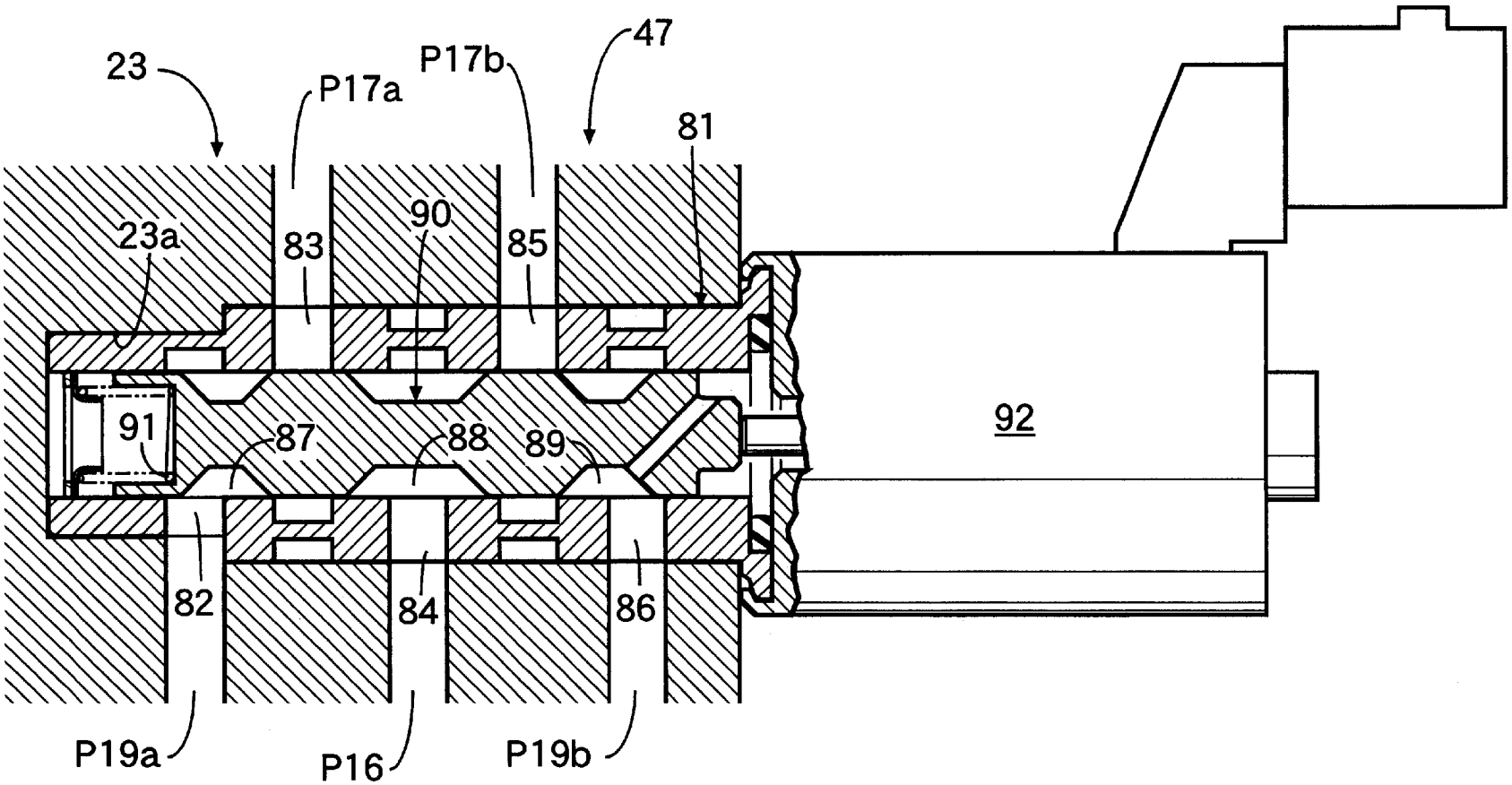

When the spool 90 is in a neutral position shown in FIG. 10, all the oil passages P16, P17*a* and P17*b* are closed. When the spool 90 is moved leftwards from the neutral position by the duty-controlled linear solenoid 92, the oil passage P16 is brought into communication with the oil passage P17*a* through the port 84, the groove 88 and the port 83, and the oil passage P17*b* is brought into communication with the oil passage P19*b* through the port 85, the groove 89 and the port 86. When the spool 90 is moved rightwards from the neutral position by the duty-controlled linear solenoid 92, the oil passage P16 is brought into communication with the oil passage P17*b* through the port 84, the groove 88 and the port 85, and the oil passage P17*a* is brought into communication with the oil passage P19*a* through the port 83, the groove 87 and the port 82.

The structure of the second valve-operating characteristic changing mechanism V2 will be described below with reference to FIGS. 11 and 12.

The second valve-operating characteristic changing mechanism V2 includes an outer rotor 93, and an inner rotor 96 fixed to the intake camshaft 12 by a pin 94 and bolts 95. The outer rotor 93 includes a cup-shaped housing 97, on an outer periphery of which the intake camshaft sprocket 15 is integrally formed, an outer rotor body 98 fitted into the housing 97, and an annular cover plate 99 which covers an opening in the housing 97. The housing 97, the outer rotor body 98 and the cover plate 99 are integrally coupled to one another. A support bore 97*a* is made in the center of the housing 97, so that the outer rotor 93 is relatively rotatably supported on the intake camshaft 12 by fitting of the support bore 97*a* over an outer periphery of the intake camshaft 12.

Four recesses 98*a* and four projections 98*b* are formed alternately around an inner periphery of the outer rotor body 98, and four vanes 96*a* radiately formed around an outer periphery of the inner rotor 96 are fitted into the four recesses 98*a*, respectively. Seal members 101 are mounted at tip ends of the projections 98*b* of the outer rotor body 98 to abut against the inner rotor 96, and seal members 102 are mounted at tip ends of the vanes 96*a* of the inner rotor 96 to abut against the outer rotor body 98, whereby four advance chambers 103 and four delay chambers 104 are demarcated between the outer rotor body 98 and the inner rotor 96.

A stopper pin 105 is slidably supported in a pinhole 96*b* provided in the inner rotor 96, and an arcuate elongated groove 97*b* is provided in the housing 97 of the outer rotor 93, so that a tip end of the stopper pin 105 can be brought into engagement in the elongated groove 97*b*. The stopper pin 105 is biased in a direction away from the elongated groove 97*b* by a spring 106, and an oil chamber 107 is defined behind the stopper pin 105. When the stopper pin 105 is in a state in which it has been moved away from the elongated groove 97*b* by a repulsing force of a spring 106, the outer rotor 93 and the inner rotor 96 can be rotated relative to each other within an angle $\alpha$ (e.g., 30°) until each of the vanes 96*a* of the inner rotor 96 is moved from one end of each recess 98*a* in the outer rotor 93 to reach to the other end of the recess 98*a*. When a hydraulic pressure is supplied to the oil chamber 107 to bring the stopper pin 105 into engagement in the elongated groove 97*b*, the outer rotor 93 and the inner rotor 96 can be rotated relative to each other within an angle $\beta$ (e.g., 20°) until the stopper pin 105 is moved from one end of the elongated groove 97*b* to reach the other end of the elongated groove 97*b*.

The pairs of oil passages P18*a*, P18*b* defined in the lower camshaft holder 25 communicate with the advance chambers 103 and the delay chambers 104 through a pair of oil passages 12*a* and 12*b* defined in the intake camshaft 12 and oil passages 96*c* and 96*d* defined in the inner rotor 96, respectively. Therefore, when a hydraulic pressure is supplied to the advance chambers 103 through the second hydraulic pressure control valve 47, the low-speed intake cams 64 and 68 and the high-speed intake cam 66 are advanced relative to the intake camshaft 12 to hasten the timing of the intake valves 18, 18. When a hydraulic pressure is supplied to the delay chambers 104 through the second hydraulic pressure control valve 47, the low-speed intake cams 64 and 68 and the high-speed intake cam 66 are delayed to retard the timing the intake valves 18, 18.

An oil passage P20 is defined in the second lower camshaft holder 25 as viewed from the side of the second valve-operating characteristic changing mechanism V2 to communicate with the oil passage P13 (see FIG. 4). The oil passage P20 communicates with the oil chamber 107 facing a head of the stopper pin 105 through an oil passage 12*c* defined in the intake camshaft 12 and oil passages 95*a* and 95*b* defined in the bolt 95.

In the present embodiment, no valve-operating characteristic changing mechanism is mounted on the exhaust camshaft 13, and the exhaust valves 19, 19 are driven with a medium valve lift. In other words, the valve lift of the exhaust valves 19, 19 is medium between a valve lift (a smaller lift) provided when the intake valves 18, 18 are moved at a lower speed and a valve lift (a larger lift) provided when the intake valves 18, 18 are moved at a higher speed.

The operation of the embodiment having the above-described arrangement will be described below.

During rotation of the engine E at a lower speed, the solenoid 56 of the first hydraulic pressure control valve 34 is in its turned-off state and hence, the communication between the oil passages P4 and P8 is cut off, and the spool 53 is in its lifted position shown in FIG. 5 under the action of the repulsing force of the spring 54. In this state, the oil pump communicates with the oil chamber in the first valve-operating characteristic changing mechanism V1 via the oil passages P1 and P2 in the cylinder head 23, the oil passages P3 and P4, the orifice 53*c* and the oil passage P5 in the valve housing 51, the oil passages P9 and P10 in the cylinder head 23, the oil passages P11 and P13 in the lower camshaft holder 25 and the oil passage 32*a* in the intake rocker arm shaft 32. At this time, the hydraulic pressure transmitted to the oil chamber 58*a* in the first valve-operating characteristic changing mechanism V1 is brought into a lower pressure by the action of the orifice 53*c* in the first hydraulic pressure control valve 34. Therefore, the first, second and third switching pins 69, 70 and 71 are retained in the positions shown in FIG. 9, and the pair of intake valves 18, 18 are driven with the lower valve lift, and a valve operating system (including a rocker arm support portion, a camshaft support portion and the like) can be lubricated by the oil having the lower pressure.

Figure 11:
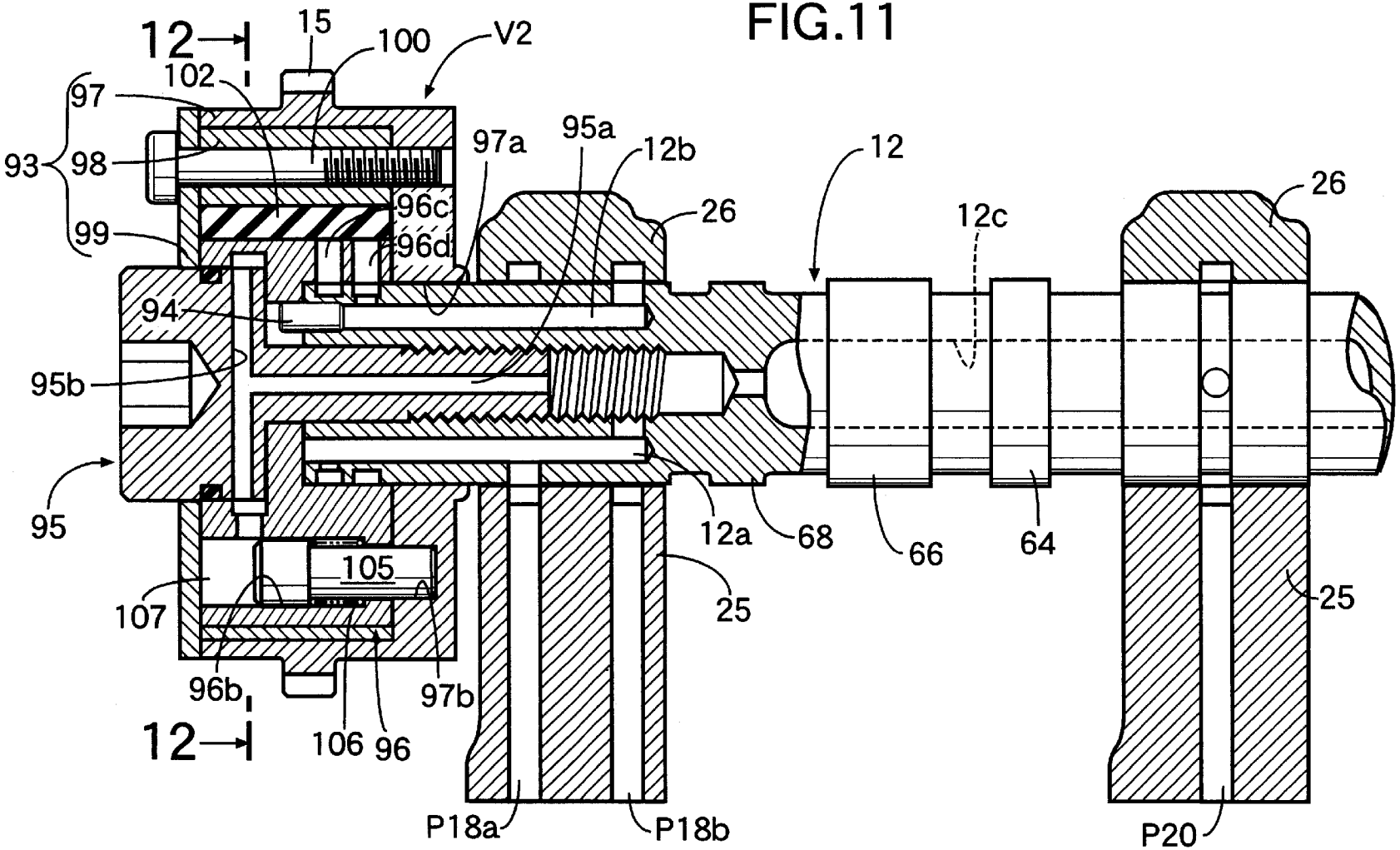
Figure 12:
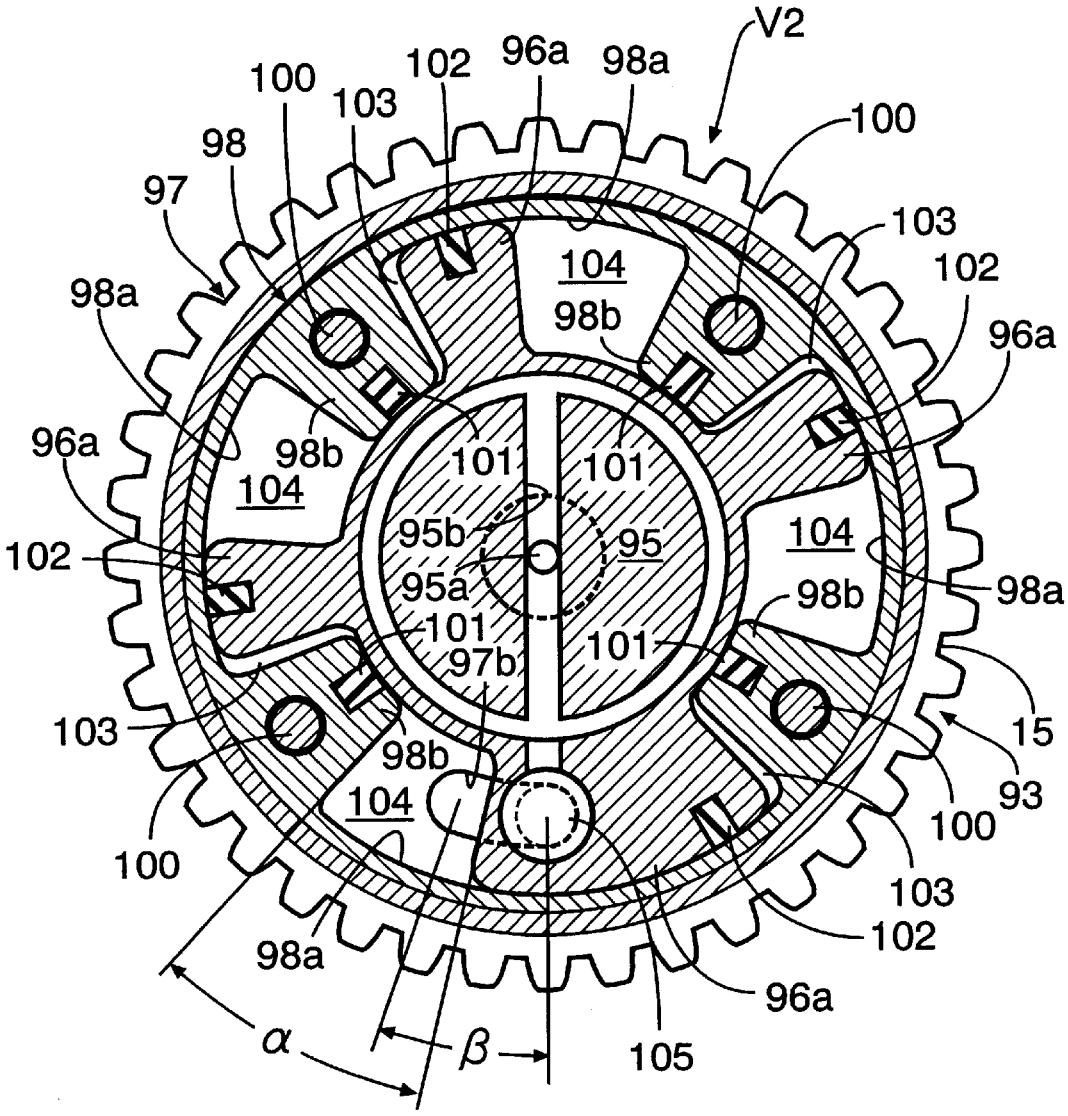

When the hydraulic pressure output from the first hydraulic pressure control valve 34 is lower, as described above, the hydraulic pressure transmitted to the oil chamber 107 in the second valve-operating characteristic changing mechanism V2 through the oil passage P20 in the lower camshaft holder 25 and the oil passage 12*c* in the intake camshaft 12 shown in FIG. 11 is also brought into a lower pressure, and the stopper pin 105 is moved away from the elongated groove 97 by the repulsing force of the spring 106. When the duty ratio of the second hydraulic pressure control valve 47 (see FIG. 10) connected to the oil pump through the oil passages P1 and P14 in the cylinder head 23, the oil passage P15 in the filter housing 45 and the oil passage P16 in the cylinder head 23 is controlled, a difference is generated between the hydraulic pressures transmitted to the advance chambers 103 and the delay chambers 104 in the second valve-operating characteristic changing mechanism V2 through the pair of oil passages P17*a* and P17*b*. As a result, the phase of the inner rotor 96 relative to the outer rotor 93 can be changed within the angle $\alpha$ (see FIG. 12), thereby controlling the valve timing of the intake valves 18, 18.

During the rotation of the engine at the lower speed described above, the oil passed through the orifice 53*c* in the first hydraulic pressure control valve 34 to have a reduced pressure (i.e., the relieved oil) flows via the oil passage P5, the groove 53*c* in the spool 53, the drain port 51*b*, the oil passage P6 in the cylinder head 23 and the oil passage P7 in the bulge 25*a* of the lower camshaft holder 25 and through the oil drain port 25*b* to the zone of starting of the meshing of the exhaust camshaft sprocket 16 and the timing chain 17 (or a meshed zone between the exhaust camshaft sprocket 16 and the timing chain 17), thereby lubricating the timing chain 17 (see FIG. 7). During the rotation of the engine at the lower speed, the rotational speed of the timing chain 17 is also smaller and hence, the oil deposited to the timing chain 17 is scattered in a reduced amount by a centrifugal force. Therefore, if the oil is supplied to the zone of starting of the meshing of the exhaust camshaft sprocket 16 and the timing chain 17 on the delayed side in a direction of rotation of the timing chain 17, the meshed zone between the exhaust camshaft sprocket 16 and the timing chain 17 on the advanced side in the direction of rotation of the timing chain 17 can be also lubricated sufficiently, because the engine E is in a state in which it is being rotated at the lower speed, and the load of the timing chain 17 is smaller.

The relived oil from the first hydraulic pressure control valve 34 is permitted to flow out of the oil drain port 25*b* to lubricate the timing chain 17, as described above, and hence, an oil jet and a space for mounting of the oil jet are not required. Moreover, the oil passage P7 leading to the oil drain port 25*b* is defined in the mating surfaces of the cylinder head 23 and the lower camshaft holder 25 and hence, the arrangement of the oil passage P7 is simplified. In addition, the first hydraulic pressure control valve 34 is mounted to a sidewall of the cylinder head 23 closer to the oil drain port 25*b* and hence, as compared with a case where the first hydraulic pressure control valve 34 is mounted to a sidewall of the cylinder head 23 farther from the oil drain port 25*b*, the length of the oil passage P7 for the relieved oil can be reduced, and the mounting rigidity of the first hydraulic pressure control valve 34 is also increased.

Further, the first hydraulic pressure control valve 34 and the oil passage P7 for the relieved oil defined in the mating surfaces of the cylinder head 23 and the lower camshaft holder 25 are disposed on the same plane perpendicular to the camshafts 12 and 13 and hence, the lengths of the oil passages P6 and P7 from the first hydraulic pressure control valve 34 to the oil drain port 25*b* can be further reduced.

Figure 6:
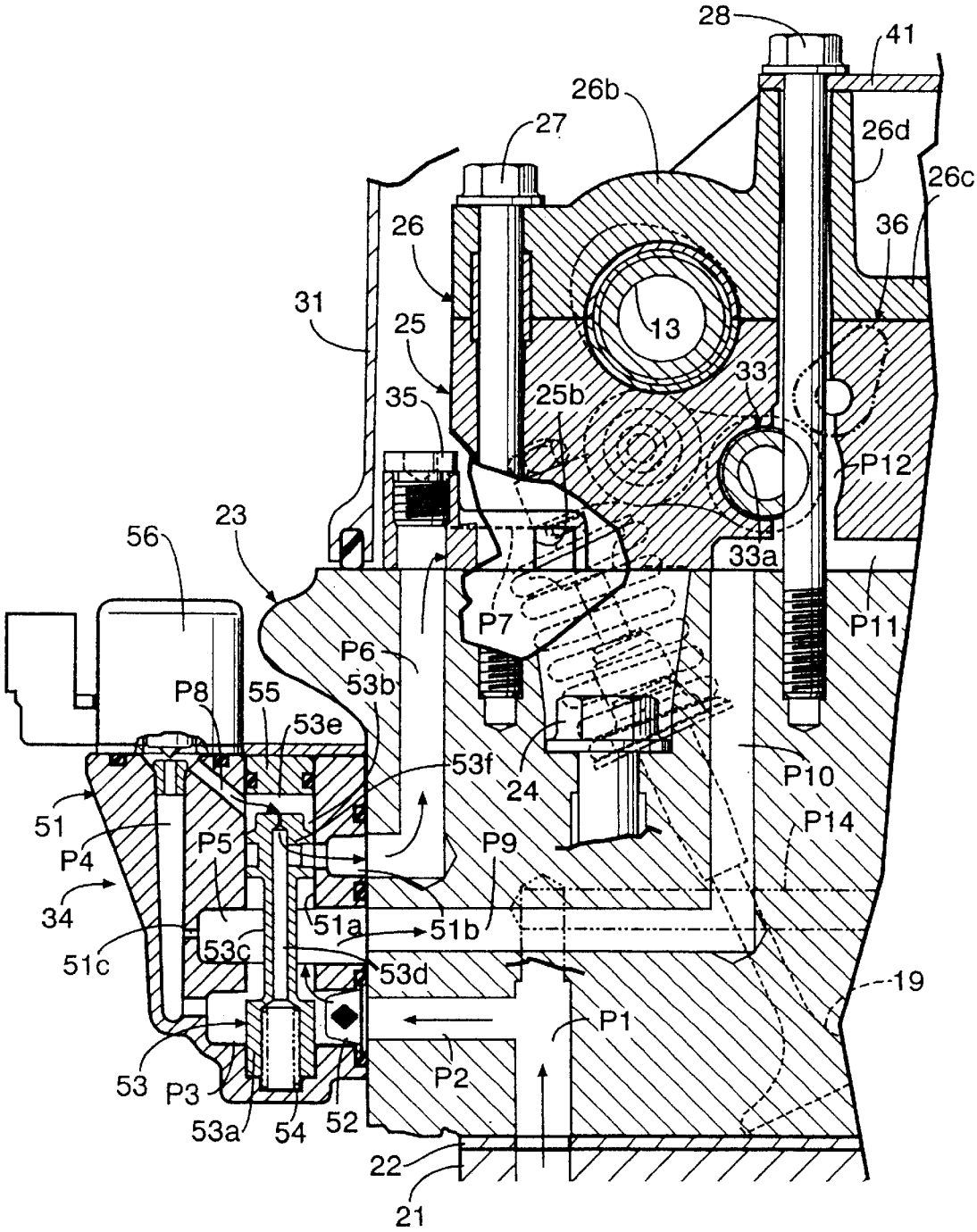

When the solenoid 56 of the first hydraulic pressure control valve 34 is brought into the turned-on state during rotation of the engine E at a higher speed to permit the communication between the oil passages P4 and P8, whereby the spool 53 is moved downwards by the hydraulic pressure applied to the land 53*b,* as shown in FIG. 6, the oil passages P3 and P5 are brought into communication with each other through the groove 53*c*. As a result, the higher hydraulic pressure is transmitted via the oil passages P9 and P10 in the cylinder head 23, the oil passages P11 and P13 in the lower camshaft holder 25 and the oil passage 32*a* in the intake rocker arm shaft 32 to the oil chamber 58*a* in the first valve-operating characteristic changing mechanism V1 to move the first, second and third switching pins 69, 70 and 71 against the repulsing force of the spring 73, whereby the pair of intake valves 18, 18 are driven with a higher valve lift.

When the hydraulic pressure output from the first hydraulic pressure control valve 34 is higher as described above, the hydraulic pressure transmitted through the oil passage P21 in the lower camshaft holder 25 and the oil passage 12*c* in the intake camshaft 12 show in FIG. 11 to the oil chamber 107 in the second valve-operating characteristic changing mechanism V2 is also brought into a higher pressure, whereby the stopper pin 105 is brought into engagement in the elongated groove 97*b* against the repulsing force of the spring 106. Therefore, a difference can be generated between the hydraulic pressures transmitted to the advance chambers 103 and the delay chambers 104 in the second valve-operating characteristic changing mechanism V2 through the pair of oil passages P17*a* and P17*b* by controlling the duty ratio of the second hydraulic pressure control valve 47 connected to the oil pump through the oil passages P1 and P14 in the cylinder head 23, the oil passage P15 in the filter housing 45 and the oil passage P16 in the cylinder head 23, whereby the phase of the inner rotor 96 relative to the outer rotor 93 can be changed within the angle β (see FIG. 12) to control the valve timing of the intake valves 18, 18.

Referring to FIG. 8, the higher-pressure oil supplied to the oil passage P12 defined around the outer periphery of the bolt 28 forces the relief valve 40 in the mounting bolt 39 of the oil jet 36 open, and spouts out of the nozzle bore 37*a* in the oil jet body 37 to lubricate the zone of starting of the meshing (or the meshed zone) of the intake camshaft sprocket 15 and the timing chain 17. Referring to FIG. 6, the oil supplied to the oil passage P8 in the first hydraulic prepressure control valve 34 flows via the orifice 53*e,* the internal bore 53*d* and the groove 53*f* in the spool 53, the drain port 51*b* in the valve housing 51, the oil passage P6 in the cylinder head 23 and the oil passage P7 in the bulge 25*a* of the lower camshaft holder 25 and through the oil drain port 25*b* to the zone of starting of the meshing (or the meshed zone) of the exhaust camshaft sprocket 16 and the timing chain 17 to lubricate the timing chain 17 (see FIG. 7).

In this way, during the rotation of the engine E at the lower speed in which the load of the timing chain 17 is reduced, only the zone of starting of the meshing of the exhaust camshaft sprocket 16 and the timing chain 17 is lubricated. During the rotation of the engine E at the higher speed in which the load of the timing chain 17 is increased, the zone of starting of the meshing of the intake camshaft sprocket 15 and the timing chain 17 is lubricated concentratedly by the oil from the oil jet 36 and at the same time, the zone of starting of the meshing of the exhaust camshaft sprocket 16 and the timing chain 17 is lubricated subsidiarily by the relived oil from the oil drain port 25*b*. Therefore, it is possible to lubricate the timing chain 17 optimally in accordance with the operational state of the engine E to enhance the durability thereof.

In other words, the operations of the oil drain port 25*b* and the oil jet 36 which are a plurality of oil supply means for supplying the oil to the timing chain 17 are changed in accordance with the operational state of the engine E and hence, it is possible to carry out the lubrication of the timing chain 17 in accordance with the operational state of the engine E to reduce the wear of the timing chain 17. Moreover, the number of the oil supply means operated is increased with an increase in rotational speed of the engine E and hence, it is possible to increase the number of portions to be lubricated with an increase in load to further effectively reduce the wear of the timing chain 17.

Particularly, during the rotation of the engine E at the lower speed in which the valve lift (the medium valve lift) of the exhaust valves 19, 19 is larger than the valve lift (the smaller valve lift) of the intake valves 18, 18, a relatively large amount of the oil is supplied to the exhaust camshaft sprocket 16 having a load larger than that of the intake camshaft sprocket 15. During the rotation of the engine E at the higher speed in which the valve lift (the larger valve lift) of the intake valves 18, 18 is larger than the valve lift (the medium valve lift) of the exhaust valves 19, 19, a relatively large amount of the oil is supplied to the intake camshaft sprocket 15 having a load larger than that of the exhaust camshaft sprocket 16, and a smaller amount of the oil is also supplied to the exhaust camshaft sprocket 16. Thus, it is possible to ensure an optimal amount of the oil in accordance with the operational state of the engine E.

Namely, the valve operating control system includes the first valve-operating characteristic changing mechanism V1 adapted to change the magnitude relationship between the lift amount of the intake valves 18, 18 and the lift amount of the exhaust valves 19, 19 in accordance with the operational state of the engine E, so that the amount of oil supplied to the meshed zone between the sprocket for driving the valve in the larger lift amount and the timing chain is larger than the amount of oil supplied to the meshed zone between the sprocket for driving the valve in the smaller lift amount and the timing chain 17. Therefore, it is possible to supply a larger amount of the oil to the sprocket having a larger valve-operating load to extend the life of the timing chain 17. Moreover, the valve operating control system includes the first hydraulic pressure control valve 34 adapted to change the lower-speed valve lift provided when the rotational speed of the engine is lower than a predetermined value and the higher-speed valve lift provided when the rotational speed of the engine is higher than the predetermined value from one to the other, so that the lower-speed valve lift is established by the first hydraulic pressure control valve 34 during rotation of the engine E at the lower speed, and the higher-speed valve lift is established by the first hydraulic pressure control valve 34 during rotation of the engine E at the higher speed, whereby the timing chain 17 is lubricated by the lower-pressure relived oil from the first hydraulic pressure control valve 34 at the lower-speed valve lift, and the timing chain 17 is lubricated by the higher-pressure valve-lift controlling oil from the first hydraulic pressure control valve 34 at the higher-speed valve lift. Therefore, an appropriate amount of the oil in accordance with the loaded state at that time can be supplied to effectively prevent the wear of the timing chain 17.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating control system for engine, comprising a first valve-operating characteristic changing mechanism adapted to change the valve lift, and a second valve-operating characteristic changing mechanism adapted to change the valve timing, wherein a hydraulic pressure control valve for controlling the first valve-operating characteristic changing mechanism and an oil filter mounted in an oil passage leading to the second valve-operating characteristic changing mechanism are mounted respectively on one side and the other side of a cylinder head at locations outside a loop of an endless transmitting belt for driving a camshaft.

2. A valve operating control system for engine according to claim 1, wherein said hydraulic pressure control valve and said oil filter are mounted outside a cover covering the endless transmitting belt.

3. A valve operating control system for engine according to claim 1, wherein a mounted portion of said hydraulic pressure control valve and a mounted portion of said oil filter are connected to each other by reinforcing ribs and a mounting seat for said hydraulic pressure control valve for the second valve-operating characteristic changing mechanism mounted in the cylinder head.

4. A valve operating control system for engine according to claim 2, wherein a mounted portion of said hydraulic pressure control valve and a mounted portion of said oil filter are connected to each other by reinforcing ribs and a mounting seat for said hydraulic pressure control valve for the second valve-operating characteristic changing mechanism mounted in the cylinder head.

5. A valve operating control system for engine according to claim 1 or 2, wherein the second valve-operating characteristic changing mechanism and the oil filter are mounted on the same side of the cylinder head.

6. A valve operating control system for engine according to claim 3, wherein the second valve-operating characteristic changing mechanism and the oil filter are mounted on the same side of the cylinder head.

7. A valve operating control system for engine according to claim 1, wherein a mounting seat for the hydraulic pressure control valve for said second valve-operating characteristic changing mechanism is provided on an end face of the cylinder head sandwiched between a mounted portion of the hydraulic pressure control valve for the first valve-operating characteristic changing mechanism and a mounted portion of the oil filter.

8. A valve operating control system for engine according to claim 7, wherein the mounting seat for the hydraulic pressure control valve for the second valve-operating characteristic changing mechanism and the mounted portion of the hydraulic pressure control valve for the first valve-operating characteristic changing mechanism are connected to each other by reinforcing ribs.

9. A valve operating control system for engine according to claim 7, wherein said mounting seat for the hydraulic pressure control valve and said mounted portion of the oil filter for the second valve-operating characteristic changing mechanism are connected to each other by reinforcing ribs.

10. A valve operating control system for engine according to claim 7, wherein said mounting seat for the hydraulic pressure control valve for the second valve-operating characteristic changing mechanism is connected to said mounted portion of the hydraulic pressure control valve for the first valve-operating characteristic changing mechanism and said mounted portion of the oil filter by reinforcing ribs.

11. A valve operating control system for engine according to claim 1, wherein a mounted portion of the oil filter protrudes from the side of the cylinder head.

12. A valve operating control system for engine according to claim 11, wherein said mounted portion of the oil filter protruding from the side of the cylinder head is box-shaped.

13. A valve operating control system for engine according to claim 1, wherein a guide for the endless transmitting belt is fixed to a mounted portion of the oil filter.

14. A valve operating control system for engine according to claim 1, wherein a cover for the endless transmitting belt is fixed to a mounted portion of the oil filter.

15. A valve operating control system for engine according to claim 1, wherein the filter housing of the oil filter is formed of a flat member.

16. A valve operating control system for engine according to claim 1, wherein an inlet chamber and an outlet chamber for the oil are defined within the filter housing of the oil filter coupled to the cylinder head, and a common twin ring-shaped seal member for sealing said inlet chamber and said outlet chamber is disposed on the coupled surface of the filter housing to the cylinder head.

17. A valve operating control system for engine according to claim 16, wherein said outlet chamber is defined in the vicinity of bolt bores for fixing the filter housing to the cylinder head.

18. A valve operating control system for engine according to claim 1, wherein the filter housing of the oil filter coupled to the cylinder head is disposed to close an oil passage opening into an end face of the cylinder head and leading to the oil filter.

* * * * *